United States Patent [19]

Musante et al.

[11] Patent Number: 4,934,245

[45] Date of Patent: Jun. 19, 1990

[54] ACTIVE SPALL SUPPRESSION ARMOR

[75] Inventors: Ronald E. Musante, Los Altos; John D. Morrow, San Jose, both of Calif.

[73] Assignee: FMC Corporation, Chicago, Ill.

[21] Appl. No.: 98,633

[22] Filed: Sep. 18, 1987

[51] Int. Cl.[5] ..... F41H 5/04

[52] U.S. Cl. ..... 89/36.02; 428/911; 428/328

[58] Field of Search ..... 89/36.01, 36.02; 428/911, 147, 148, 242, 328, 389

[56] References Cited

U.S. PATENT DOCUMENTS

| | | | |
|---|---|---|---|
| 2,036,903 | 4/1936 | Webster . | |
| 2,372,607 | 3/1945 | Schwarzkopf . | |
| 2,391,353 | 12/1945 | Sheridan | 109/85 |
| 2,861,021 | 11/1958 | Dietz et al. . | |
| 2,922,483 | 1/1960 | Harris . | |
| 3,013,904 | 12/1961 | Cupery | 428/329 |
| 3,444,033 | 5/1969 | King | 161/38 |
| 3,592,147 | 7/1971 | Harper | 109/1 |
| 3,634,177 | 1/1972 | Glasser . | |
| 3,649,426 | 3/1972 | Gates . | |
| 3,705,558 | 12/1972 | McDougal et al. | 428/911 |
| 3,771,418 | 11/1973 | Gulbierz et al. | 428/911 |
| 3,962,976 | 6/1976 | Kelsey | 89/36.02 |
| 3,969,563 | 7/1976 | Hollis | 428/175 |
| 4,012,549 | 3/1977 | Slysh | 428/116 |
| 4,030,427 | 6/1977 | Goldstein | 89/36.02 |
| 4,042,559 | 8/1977 | Abelson et al. | 428/147 |
| 4,061,815 | 12/1977 | Poole, Jr. | 428/215 |
| 4,186,648 | 2/1980 | Clausen et al. | 89/36.02 |
| 4,241,457 | 12/1980 | Klein et al. | 89/36.02 |
| 4,300,439 | 11/1981 | Degnan et al. | 89/36.02 |
| 4,664,967 | 5/1987 | Tasdemiroglu | 428/220 |
| 4,704,943 | 11/1987 | McDougal | 89/36.02 |

FOREIGN PATENT DOCUMENTS

| | | | |
|---|---|---|---|
| 2201637 | 8/1973 | Fed. Rep. of Germany | 89/36.02 |
| 2744905 | 4/1979 | Fed. Rep. of Germany | 89/36.02 |
| 3508848 | 9/1986 | Fed. Rep. of Germany | 89/36.02 |
| 746371 | 3/1956 | United Kingdom . | |
| 1318351 | 5/1973 | United Kingdom | 89/36.02 |
| 1500899 | 2/1978 | United Kingdom | 89/36.02 |
| 2149482 | 6/1985 | United Kingdom | 89/36.02 |

OTHER PUBLICATIONS

Rugger et al., Kirk-Othmer Encyclopedia Chemical Technology, 1971, pp. 138-157.

Mayseless et al., Journal of Applied Mechanics, 1987, pp. 373-378.

An article entitled Porosity and Spall Fracture of Shock Loaded Metals, by Corly M. Glass et al.

Article entitled Porosity and Spall Fractures of Shock Loaded Metals, Coy N. Glass, Victor A. Greenhut and Pricilla W. Kingman date stamped 1976.

Article entitled Shock Effects on Interfaces prepared by U.S. Army Mobility Equipment Research Department Command.

Article entitled Determination of Dynamic Fracture Parameters for HF-1 by Willis Mock, Jr. and William H. Holt published Apr. 14, 1982.

*Primary Examiner*—Charles T. Jordan

*Assistant Examiner*—Stephen Johnson

*Attorney, Agent, or Firm*—A. J. Moore; R. C. Kamp; R. B. Megley

[57] ABSTRACT

A spall backing material contiguously attached to an armor plate at least suppresses the formation of lethal armor spall from being propelled from the inner surface of the armor plate when the outer surface of the armor is impacted by a weapon with sufficient impact to release high velocity spall from unprotected armor. When the impedance of the spall suppression armor is equal to or greater than the impedance of the armor plate, the formation of lethal spall in the armor will be prevented. When the spall backing material is reduced in thickness to minimize weight and has an impedance lower than that of the armor plate, or a more powerful weapon is used, armor spallation will occur but will be suppressed by the spall backing material to minimize lethality.

3 Claims, 8 Drawing Sheets

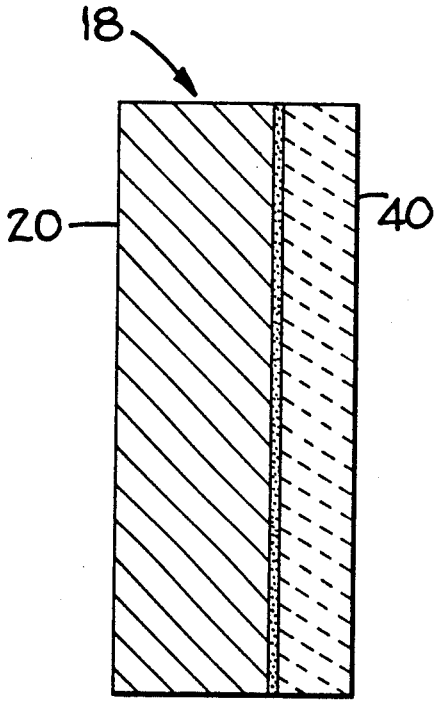
FIG_6
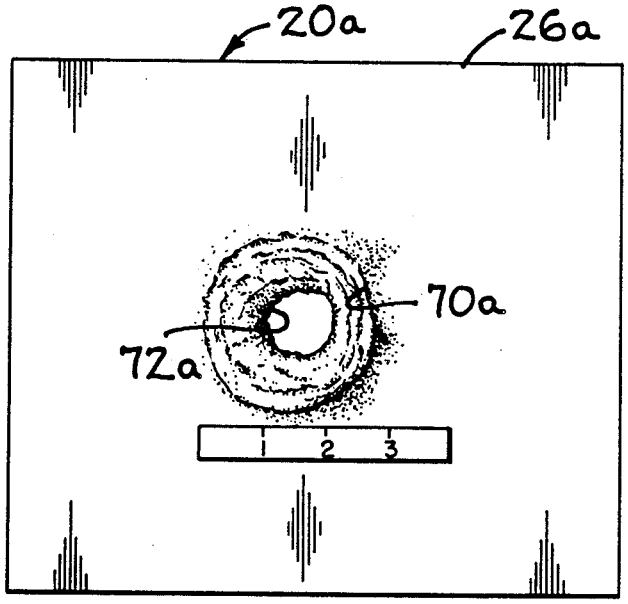
FIG_7A
FIG_7B
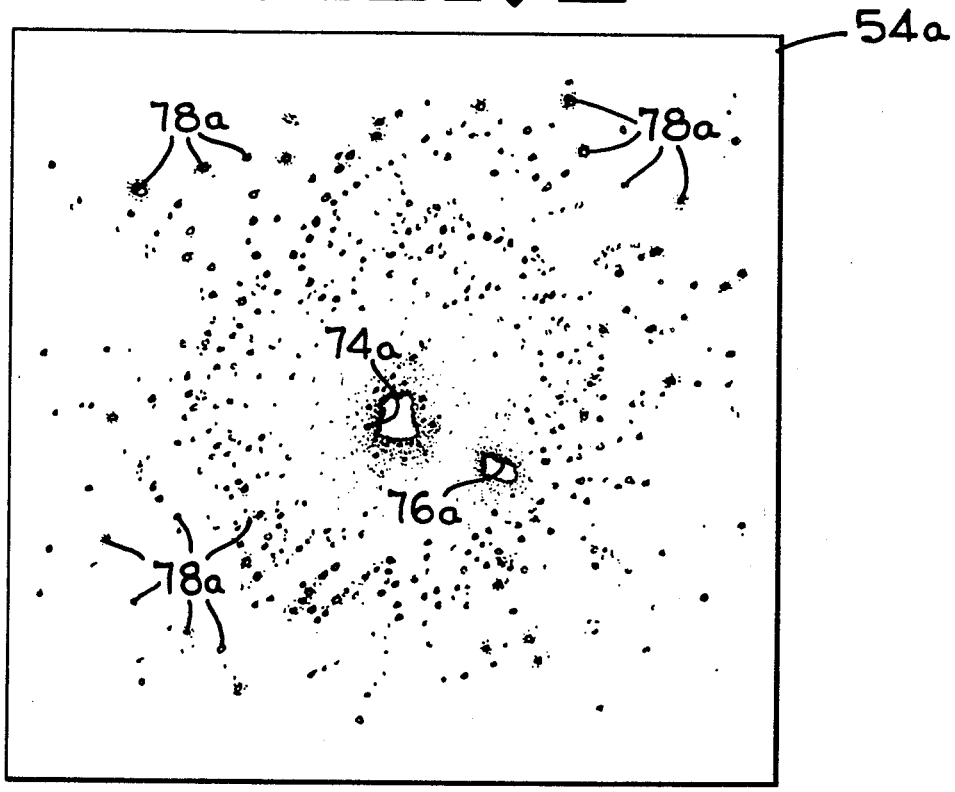

ACTIVE SPALL SUPPRESSION ARMOR

BACKGROUND OF THE INVENTION

1. Field of the Invention

The present invention relates to suppression or elimination of spall from being propelled off the inside surface of armor plate used in the armored body of a combat vehicle or the like, by contiguously attaching light weight spall backing material having a sonic impedance such that the stress reflected into the armor is below that which causes lethal spallation in the armor. If the lightweight spall backing does fracture, the resulting spall is comprised of non-lethal fragments of low mass and/or kinetic energy.

2. Description of the Prior Art

It is well recognized that spall is a primary cause of armor vehicle kills during combat. Spall may be characterized as a cloud of high velocity fragments of metal which is released from the inside surface of the vehicle's armored hull and is lethal to soft targets inside the vehicle. The soft targets include electrical cables, electrical components, fuel lines, fuel cells, and personnel within the vehicle.

Spall liners are currently being used for minimizing the spall effect but are quite expensive and heavy. The effectiveness of these liners require that the liners be spaced from about 4 to 17 inches from the inner wall of the vehicle and are therefore undesirable since the useable space within most vehicles is quite limited. Also, the hardware within the vehicles makes it difficult or impossible to secure the liner within all portions of the vehicle without interfering with the operation and location of vehicle components. Thus, certain areas of the combat vehicles may not be protected by liners.

SUMMARY OF THE INVENTION

The active spall suppression armor includes an armor material or plate backed by a spall backing material which is contiguously attached to the inside surface of the armor, typically by adhesives. The spall backing material may be of the consistency of pliable putty or may be in the form of hard tiles or sheets. In the event that the spall backing consists of a uniform dispersion of particles in a binder matrix, the matrix binder may serve to contiguously adhere the backing material to the armor. The spall material if fractured, due to excessive stresses transmitted through the armor material, form nonlethal fragments of low mass and kinetic energy. The sonic impedance of the spall material is such that the stress reflected by the spall backing material into the armor is equal to or slightly below that which causes failure in the armor, which failure would result in lethal spall particles being propelled from the inner surface of the metal armor. Spall may be created in the backing material but the effect is minimized by assuring that the spall created in the backing material has low energy and is therefore not lethal. The armor material may be steel armor, aluminum armor, and other types of armor including composite materials.

BRIEF DESCRIPTION OF THE DRAWINGS

FIG. 6 is a vertical section taken through an armor plate having a spall backing material contiguously attached thereto by an optional interlayer.

FIG. 7A is a copy of a photograph illustrating the back of an armor test plate without spall backing illustrating the area from which armor spall has been released and further illustrating a hole therein formed by the shaped charge jet.

FIG. 7B is a copy of a photograph illustrating the front of a witness plate illustrating the usual pattern of holes formed therein from spall from the armor plate of FIG. 7A and the slug from the shaped charge liner, respectively.

DESCRIPTION OF THE PREFERRED EMBODIMENT

Prior to describing the active spall suppression armor 18 of the present invention, it is believed that a brief description of spallation would be helpful.

Figure 1:
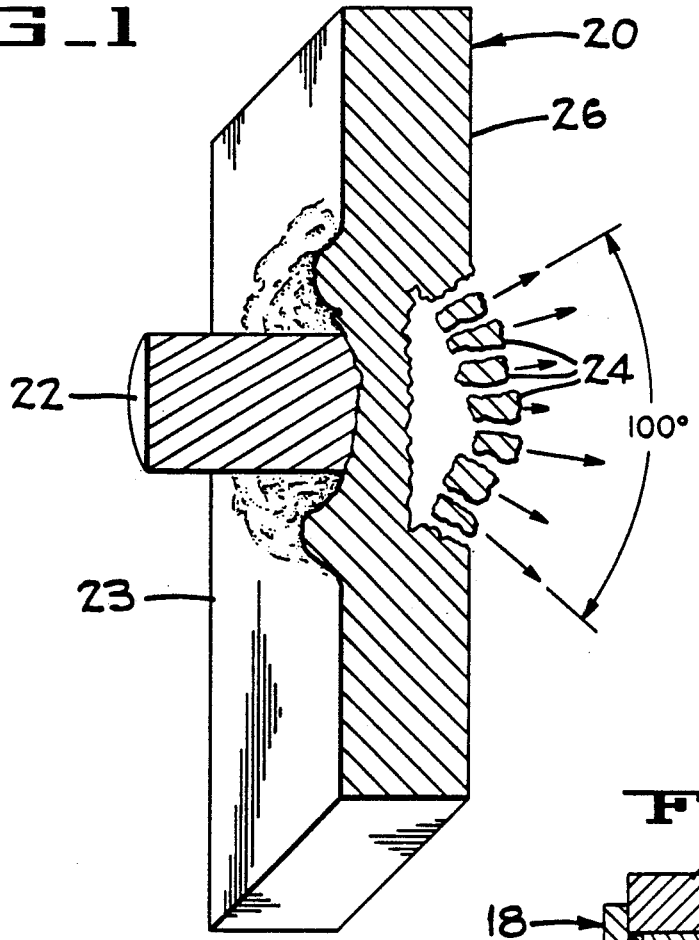
FIG. 1 is a perspective in section illustrating an armor plate without spall backing material attached thereto being impacted by a spaced charge, or projectile, and showing armor spall being discharged therefrom.

FIG. 1 diagrammatically illustrates a section of metal armor 20 without a spall backing material attached thereto, being contacted by a weapon 22 which may be a shaped charge or a high velocity projectile. The weapon 22 contacts an outer surface 23 of the armor with sufficient force to dislodge spall fragments 24 from the free or inner surface 26 of the armor 20. The spall fragments are propelled from the inner surface 26 of the armor along a conical path of about 100° at high velocity with many of the fragments being of sufficient mass to be lethal to soft targets that are contacted by the fragments. More particularly, spalling is a failure mode wherein fracture occurs near the free surface 26 (FIG. 1) remote from the outer surface 23 where an impulse load is applied. The impulse load is typically generated by an explosive detonation from a space charge, or by the impact of a high velocity projectile. The impulse induces a compressive shock wave which propagates to the opposite free surface 26 where it reflects as a tensile wave. The intensity of the tensile wave will increase as it propagates back through the material. At some distance from the surface 26, the stress intensity exceeds the threshold required for initiation and fracture at which time spallation occurs discharging the spall 24 inwardly at high velocity.

Figure 2:
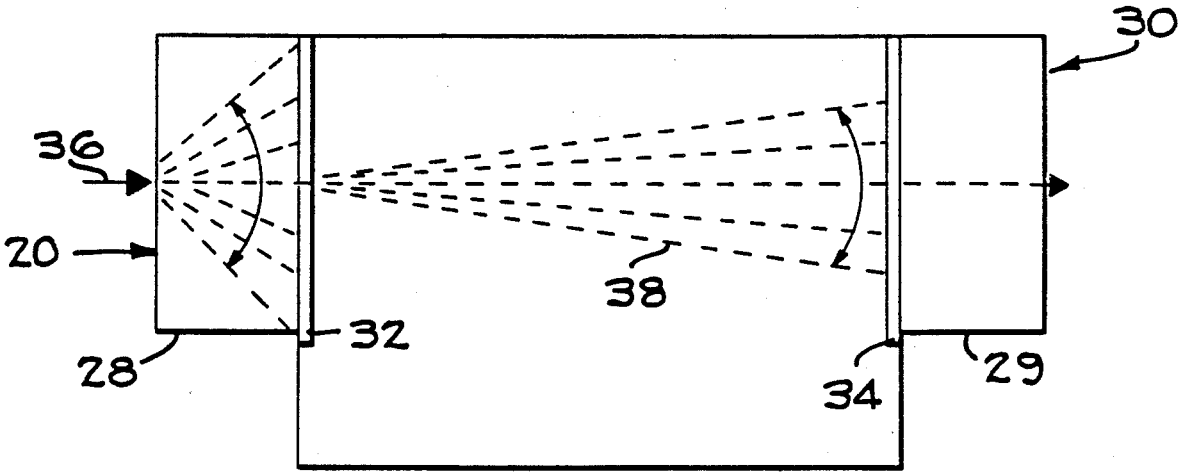
FIG. 2 is a diagrammatic elevation of a military vehicle illustrating a projectile passing through the two armor walls and two spall liners of a prior art vehicle illustrating spall cone angles.

FIG. 2 diagrammatically illustrates a vertical section through two armor plate walls 28,29 of a vehicle 30 having two prior art spall liners 32,34 spaced inwardly of the vehicle. The path 36 of the projectile is illustrated by arrows as passing through both walls 28,29 and liners 32,34. However, a primary spall cone angle in the first contacted wall 28 indicates that the first spall liner 32 stops some spall but allows larger high velocity pieces to pass through and be stopped by a second spall liner 34 as illustrated by a narrow secondary spall cone 38.

Figure 4:
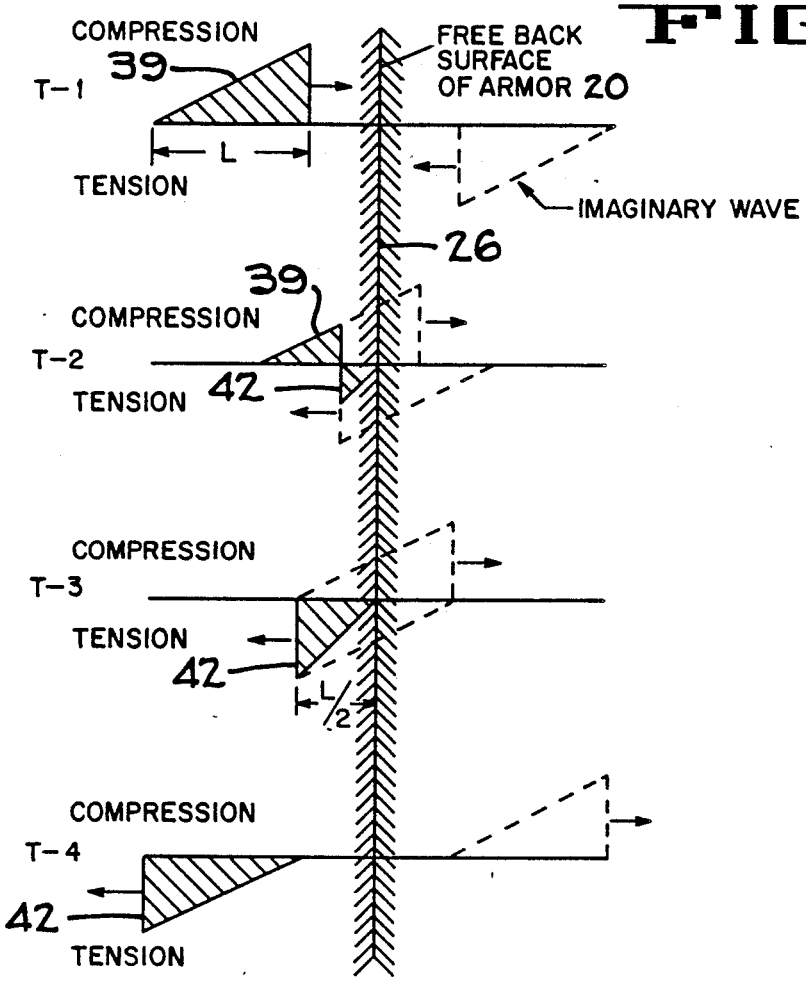
FIG. 4 is a diagrammatic elevation illustrating a saw-toothed stress wave created in the armor by the impact of a shaped charge explosive at four separate time intervals relative to the free inner surface of the metal armor.

FIG. 4 represents stresses caused by shaped charge weapons and illustrates the formation of compressive and tensile waves when passing through the first contacted armor at four separate time intervals to the free surface 26 without spall backing material attached thereto. At time T-1 a saw-tooth wave or pulse 39 illustrates the stress intensity relative to the back or inner surface 26 of the armor caused by the detonation of an explosive. As illustrated at time T-2, when the compressive wave 39 reaches the free surface 26 it reflects as a tensile wave 42, which is partially cancelled by the incident compressive pulse 39. The tensile stress will increase until the maximum stress occurs at a distance from the surface 26 of the plate 20 equal to one-half of the pulse length as indicated at time T-3. At time T-4 the intensity of the tensile wave exceeds the compressive wave thus indicating that spall will not be created.

When a projectile, as opposed to an explosive detonation or a shaped charge, applies the impact load, a square wave (not shown) is produced which will provide no tensile stress until the maximum occurs at the half pulse distance at T-3 of FIG. 4.

The creation of spall fracture is dependent upon both the magnitude and duration of stress. Sufficient time at the sufficient stress are required to first nucleate cracks, and then to grow the cracks. Fracture is therefore dependent upon amplitude and the shape of the stress pulse. When the condition of stress intensity and time are such that the criterian for fracture are met, then the spall will be formed. When fracture occurs, the strain energy remaining in the material between the fracture and the rear face is released as kinetic energy and the spall particles fly from the rear face, usually with significant velocity. The velocity is limited theoretically by the equation: $V=2\ M/DC$ where M is the magnitude of the stress wave, D is the density of the material, and C is the material sound speed.

Interaction of Stress Waves at Interfaces

When a stress wave encounters an interface or free surface 26 between two dissimilar materials such as the armor plate material 20 (FIGS. 5A,5B and 6) and the spall backing material 40, the stress waves behavior becomes more complex. The simplest situation is a normal impact by a projectile with a diameter of the same order of magnitude as the armor plate thickness. The stress wave can then be considered to have a planar front and to travel perpendicular to the face of the plate. In general, when this wave reaches an interface, one wave is reflected and another is transmitted. The intensities of the waves are dependent upon the relative sonic impedances of the two materials.

The sonic impedance (Z) of a material is the product of the sound speed (c) in the material, and its density (D). The values of density and sound speed are not constant, but vary to some degree with pressure. Consequently, impedance can vary with the pressure and will definitely change when the yield strength of a material is exceeded. Generally, for most fully dense, elastic materials, the impedance below the yield point is relatively constant. The density, sound speed, and impedance are listed in Table 1 for a number of common materials. The intensities of the transmitted and reflected waves from a stress wave impinging an internal interface are given by the following equations:

$$R = I(D_2 C_2 - D_1 C_1)/(D_2 C_2 + D_1 C_1) \qquad \text{A}$$

and;

$$T = I(2D_1 C_1)/(D_2 C_2 - D_1 C_1)$$

or;

$$R = I(Z_2 - Z_1)/(Z_2 + Z_1)$$

and;

$$T = I(2Z_1)/(Z_2 - Z_1)$$

where;

R=REFLECTED WAVES
T=TRANSMITTED WAVES
I=INCIDENT WAVES
Z=IMPEDANCE OF THE MATERIAL
D=DENSITY and where subscript;

1=the armor material
2=the spall backing material

By convention, compressive stress has a positive value and tensile stress has a negative value.

Figure 5A:
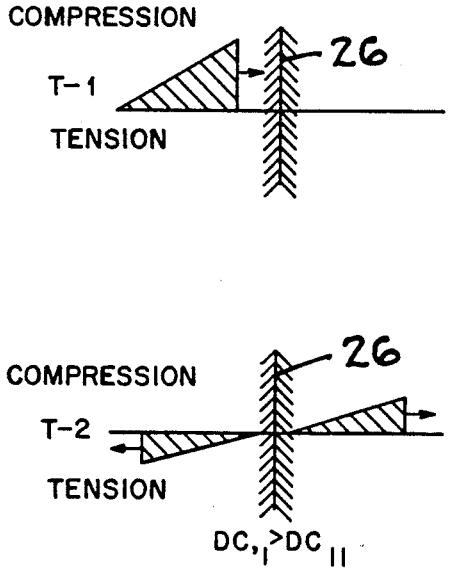
FIG. 5A is a diagram illustrating the saw toothed stress waves at an interface between an armor plate and a backing material having a lower sonic impedance than that of the armor plate.
Figure 5B:
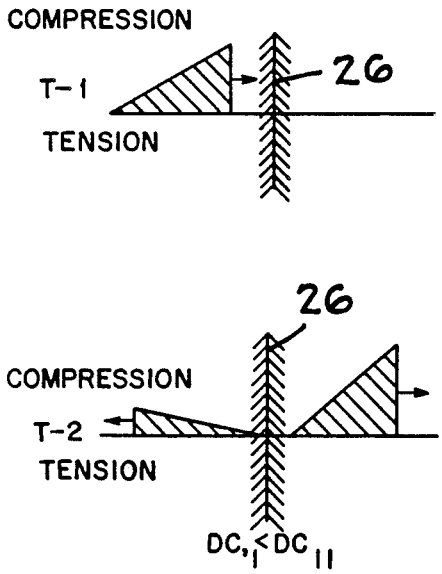
FIG. 5B is a diagram illustrating the saw-toothed stress waves at an interface between an armor plate and a backing material having a greater sonic impedance than the armor plate.

From the above equations, a compressive wave will reflect as a tensile wave in the armor material if the second layer or backing material has a lower impedance, as illustrated in FIG. 5A; and as a compressive wave if the backing material has a higher impedance as illustrated in FIG. 5B. The amplitude of the reflected tensile wave will always be less than or equal to that of the incident compressive wave.

The relative intensity of the reflected wave in the armor material is related to the relative impedance of the spall backing material as follows:

For an impedance ratio (n) of the armor material the following equations apply:

$$n = Z_2/Z_1$$

$$R_I = (Z_2 - Z_1)/(Z_2 + Z_1) = nZ_1 - Z_1/(nZ_1 + Z_1)$$

or;

$$R_I = (n - 1)/(n + 1)$$

This ratio is tabulated in Table 1 to illustrate how a second layer, or backing material 40 (FIG. 6), can be used to reduce the magnitude of the reflected stress. It can be seen that a material with only one-fifth of the impedance of the first layer (armor material) can reduce the reflected tensile stress by as much as 33 percent.

TABLE 1

Density D, sound speed (C) and Impedance values (Z) for selected materials.

| MAT'L | D (lb/ft$^3$) | C (k ft/s) | Z (k lb/ft$^2$ sec × 10$^5$) |
|---|---|---|---|
| Aluminum | 88.6 | 17.8 | 1.58 |
| 6061-T6 Aluminum | 88.7 | 17.1 | 1.52 |
| 2024 Aluminum | 91.4 | 17.2 | 1.57 |
| Berylliun | 60.7 | 26.5 | 1.61 |
| Brass | 276.6 | 12.2 | 3.36 |
| Boron Carbide (75% Dense) | 63.0 | 9.7 | 0.61 |
| Silicon Carbide (72% Dense) | 76.1 | 9.4 | 0.71 |
| Tungsten Carbide | 492.8 | 17.0 | 8.38 |
| Carbon Phenolic | 48.9 | 13.8 | 0.67 |
| Chromium | 233.6 | 17.4 | 4.06 |
| Cobalt | 289.4 | 15.7 | 4.56 |
| Copper | 293.0 | 12.9 | 3.77 |
| Epoxy | 39.4 | 8.8 | 0.34 |
| Graphite (Commercial) | 53.4 | 4.8 | 0.26 |
| Pyrolitic Graphite | 72.2 | 13.6 | 0.98 |
| Armco Iron | 257.6 | 14.8 | 3.80 |
| Lucite | 38.7 | 7.2 | 0.28 |
| Magnesium | 57.3 | 14.9 | 0.85 |
| Manganin | 277.6 | 12.5 | 3.46 |
| Mylar | 45.6 | 7.2 | 0.33 |
| Nickel | 290.7 | 15.3 | 4.44 |
| Nylon | 37.4 | 7.1 | 0.26 |
| Paraffin | 30.1 | 9.7 | 0.29 |
| Phenolic Fiberglass (AVCO) | 62.3 | 5.6 | 0.35 |
| Phenolic Fiberglass (GE) | 63.7 | 10.7 | 0.68 |
| X-Cut Crystalline Quartz | 86.9 | 18.8 | 1.63 |
| Plexiglass | 38.9 | 9.0 | 0.35 |
| Polyethylene | 30.2 | 9.6 | 0.29 |
| Polystyrene | 34.5 | 9.8 | 0.34 |
| Polyurethane | 41.5 | 6.8 | 0.28 |
| 304 SS | 259.1 | 15.0 | 3.87 |
| Mild Steel (EN3) | 257.2 | 11.8 | 3.03 |
| Teflon | 70.9 | 4.7 | 0.33 |
| Tin | 238.9 | 8.4 | 2.02 |
| Titanium | 148.0 | 15.4 | 2.28 |
| Tungsten | 629.0 | 13.0 | 8.19 |
| Uranium/3% Moly. | 605.3 | 8.4 | 5.07 |

TABLE 1-continued

Density D, sound speed (C) and Impedance values (Z) for selected materials.

| MAT'L | D (lb/ft$^3$) | C (k ft/s) | Z (k lb/ft$^2$ sec × 10$^5$) |
|---|---|---|---|
| Zinc | 234.3 | 10.0 | 2.35 |
| Zirconium | 213.4 | 12.3 | 2.63 |

TABLE 2

Reduction in the reflected tensile stress for a given relative impedance of a layer of backing material.

| Impedance Ratio n | % Reduction in Reflected Tensile Stress |
|---|---|
| .10 | 18 |
| .20 | 33 |
| .30 | 46 |
| .40 | 57 |
| .50 | 67 |
| .60 | 75 |
| .70 | 82 |
| .80 | 89 |
| .90 | 95 |
| 1.00 | 100 |

When the spall suppression armor 18 (FIG. 6) of the present invention is to be used on light weight armored vehicles, as well as heavy armored vehicle, it is of course desirable to minimize any added weight to the vehicle. Accordingly, the spall backing material is not designed to completely suppress fractures in the spall backing material 40 by all known weapons but is designed to provide backing material which, if fractured, will fracture into low energy, non-lethal particles when the armored plate and backing material are contacted by a weapon, either a shaped charge weapon or a projectile. It is, of course, understood that the backing material may be thickened or be in layers of the same or different backing materials if added weight is not a problem.

The concept of the subject invention involves the backing of armor plate 20 with a backing material 40, or a series of backing materials, which must satisfy two conditions. First, the impedance of the backing material must be such that the stress reflected into the armor plate 20 is below that which would cause spall-type failure in the armor plate. Second, the fragments from the fracture of the backing material, caused by transmitted stress, must be nonlethal, that is, of low mass and/or velocity. Varying impedance in the backing material may be used to condition the stress wave in the backing material to control fragmentation. The impedance may be varied by either layering or by controlling the material properties continuously through their thicknesses.

A preliminary design analysis was made for identifying the relationship between design variables and system weights. First, the amount of the stress wave which must be transmitted into the spall backing material was estimated by comparing spall strength to the stresses involved in jet penetration. With this data, the properties of the spall backing material was determined.

The weapons used were shaped charge TOW-II with a jet impacting aluminum armor. A 200 GPa (giga pascals) shock stress was generated with a pulse time length of 1.175 microseconds, which shock stress was calculated from the jet diameter divided by the sound speed in 5083 per MIL-A-46027G(MR) aluminum having a thickness of one inch. It was assumed that the aluminum had about the same spall "strength" as steel, the stress is so much higher in the aluminum than its strength, that essentially the full amplitude of the stress wave must be transmitted into the backing material.

The relationship between the impedance of the backing material 40 and the areal density AD required to suppress spall in the aluminum armor was derived as follows:

Let:

$I_{ns}$=stress pulse wavelength in the backing material
$I_{al}$=stress pulse wavelength in the aluminum
$c_{ns}$=wave velocity in the backing material
$c_{al}$=wave velocity in the aluminum
th=minimum thickness of any backing material for passage of the full stress wave
d=diameter of the shaped charge jet
$D_{ns}$=density of the backing material
$t_{al}$=time length of the stress wave in the aluminum
$Z_{ns}$=sonic impedance of the backing material
$AD_x$=minimum areal density of backing material "x" for passage of the full stress wave The wavelength of the stress pulse in the aluminum armor can be estimated by:

$t_{al}=d/c_{al}$
$I_{al}=t_{al}c_{al}=d$

The wavelength in the backing material is:

$I_{ns}=I_{al}(c_{ns}/c_{al})$

Assuming that the backing material will separate from the aluminum when the stress wave reaches the interface after reflecting in tension from the backface of the backing material (because the interface cannot support significant tensile stress), and that conservatively, the whole wave should pass into the backing material:

$I_{ns}=2th$ or $th=(\frac{1}{2})I_{ns}$

Combining the above three equations gives the minimum backing material thickness for any given material:

$th=(d/2)c_{ns}/c_{al}$

The minimum areal density (AD) of the backing system can be calculated as follows:

$$AD = D_{ns}th = D_{ns}[(d/2)c_{ns}/c_{al}] \quad \text{(Equation 1)}$$
$$= D_{ns}c_{ns}[(d/2)c_{al}]$$

Since $Z_{ns} = D_{ns}c_{ns}$:

$$AD = Z_{ns}[(D/2)c_{al}] \quad \text{(Equation 2)}$$

Since the jet diameter, d, and the aluminum wave velocity, $c_{al}$, are constant for any given case, the minimum areal density of a backing system is linearly related to its impedance. If again it is conservatively assumed that there must be no reflected tensile wave in the aluminum, then the optimum backing material areal density will be when the Impedance of the backing material matches that of the aluminum.

Sample calculations

Assuming a $\frac{3}{8}$ inch jet diameter vs. aluminum armor with aluminum as a backing material (matched Impedance), optimum areal density can be calculated as follows:

Using equation (1):

$AD_{al}=D_{al}[(d/2)(c_{al}/c_{al})]=D_{al}(d/2)$

For aluminum, $D_{ns}=14$ lb/ft$^2$, which yields:

$AD_{al}=2.625$ lb/ft$^2$

The fired alumina, which worked well in the preliminary testing, would yield an optimum from equation (2) (considering that $Z_{alumina}/Z_{al}=2.33$):

$AD_{alumina}=2.625(2.33)=6.116$ lb/ft$^2$

The above calculations indicate that aluminum would be a lighter backing material than the fully-fired alumina. However, the aluminum is not frangible. While the aluminum backing material would successfully extract the stress wave from the aluminum armor plate or hull structure of a vehicle, the aluminum backing material could itself produce lethal spall.

Therefore, considering both areal density and fracture considerations, the optimum backing material could be either a pure, ductile spall resistant aluminum, or an alumina body with sufficient porosity introduced to bring its impedance down to that of aluminum. The backing material should be bonded to the hull or armor plate using a tough adhesive with relatively thin bond lines.

This design methodology also suggests the merits of a metallic or ceramic particle loaded polymer. In this case, the individual particles have a higher sonic impedance than that of the armor. However, when the particles are combined with a polymer, the particle content must be sufficient to insure that the particle/polymer blend has a sonic impedance equal to or greater than the armor plate. A particle/polymer blend may also afford the advantage of sticking directly to the armor without the need of an intermediate adhesive.

A low density strength solid which fractures in a brittle manner, and which has a suitable impedance, may also be used. For instance, solid, polycrystalline sodium chloride (NaCl) in a $\frac{1}{2}$ inch thickness has suppressed spall formation in aluminum armor when bonded to the back of the armor plate.

Figure 3:
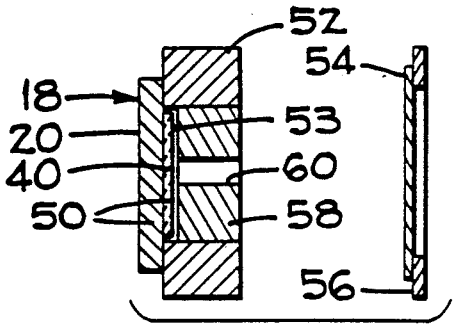
FIG. 3 is a diagrammatic elevation in vertical section illustrating an armor plate with spall backing material attached to a test stand, and a witness sheet attached to a frame.

Tests have been conducted to investigate the effect of spall backing material thickness, warhead size, obliquity, armor alloy, and armor thickness on the performance of the various backing materials. The general procedure consists of adhesively bonding the backing material 40 (FIG. 6) to the armor plate 20 which together comprise a piece of active spall suppressive armor 18 in the form of a target 50 (FIG. 3). The target is fixed to a test stand 52, and the target 50 and a witness sheet 54 are subjected to a warhead attack. Base line targets of unbacked and liner-backed armor plates were also tested for comparison purposes. The witness sheets 54 were placed behind the test stand to record the distribution of spall and jet particles. The test matrix of the shots are illustrated in Table 3.

TABLE 3

BACKING MATERIAL TEST MATRIX

| ID NO. | WAR-HEAD TYPE | OBL. | TARGET MTL. | TARGET THK. | BACKING MTL. | BACKING MTL. THK. | WITNESS MTL | WITNESS THK. GAUGE |
|---|---|---|---|---|---|---|---|---|
| 01 | TOW 11 | 0 DEG. | (MIL-A-12560) | | RHA BASELINE PENETRATION SHOT | | | |
| 02 | TOW 11 | 0 DEG. | (MIL-A-12560) | | RHA BASELINE PENETRATION SHOT | | | |
| 03 | TOW 11 | 0 DEG. | (MIL-A-12560) | | RHA BASELINE PENETRATION SHOT | | | |
| 04 | TOW 11 | 0 DEG. | 7039 | 1.0 | BISQUE | 0.44 | ST/ST | 59/59 |

TABLE 3-continued

BACKING MATERIAL TEST MATRIX

| ID NO. | WAR-HEAD TYPE | OBL. | TARGET MTL. | TARGET THK. | BACKING MTL. MTL. | BACKING MTL. THK. | WITNESS MTL | WITNESS THK. GAUGE |
|---|---|---|---|---|---|---|---|---|
| 05 | TOW 11 | 0 DEG. | 7039 | 1.0 | NONE | | AL/ST | 20/59 |
| 06 | TOW 11 | 0 DEG. | 5083 | 1.0 | NONE | | AL/ST | 20/59 |
| 07 | TOW 11 | 0 DEG. | 7039 | 1.0 | NONE | | AL/ST | 20/59 |
| 08 | TOW 11 | 0 DEG. | 7039 | 1.0 | NONE | | AL | 20 |
| 09 | TOW 11 | 0 DEG. | 7039 | 1.0 | BISQUE | 0.31 | AL | 20 |
| 10 | TOW 11 | 0 DEG. | 7039 | 1.0 | F.F. | 0.38 | AL | 20 |
| 11 | TOW 11 | 0 DEG. | 7039 | 1.0 | BISQUE | 0.44 | AL | 20 |
| 12 | TOW 11 | 0 DEG. | 7039 | 1.0 | BISQUE | 0.44 | AL | 20 |
| 13 | TOW 11 | 0 DEG. | 7039 | 1.0 | F.F. | 0.50 | AL | 20 |
| 14 | TOW 11 | 0 DEG. | 7039 | 1.0 | BISQUE | 0.59 | AL | 20 |
| 15 | TOW 11 | 0 DEG. | 7039 | 1.0 | UNF. | 0.58 | AL | 20 |
| 16 | TOW 11 | 0 DEG. | 7039 | 1.0 | UNF. | 0.30 | AL | 20 |
| 17 | TOW 11 | 0 DEG. | 7039 | 1.0 | F.F. | 0.50 | AL | 20 |
| 18 | TOW 11 | 0 DEG. | 7039 | 1.0 | AL 1100 | 0.50 | AL | 20 |
| 19 | TOW 11 | 0 DEG. | 7039 | 1.0 | AL 1100 | 0.19 | ST | 24 |
| 20 | TOW 11 | 0 DEG. | 7039 | 1.0 | AL 1100 | .19/.1 | ST | 24 |
| 21 | TOW 11 | 0 DEG. | 7039 | 1.0 | LINER | 1.38 | ST | 24 |
| 22 | 3.2" | 0 DEG. | 7039 | 1.0 | F.F. | 0.50 | ST | 24 |
| 23 | 3.2" | 0 DEG. | 7039 | 1.0 | BISQUE | 0.59 | ST | 24 |
| 24 | 3.2" | 0 DEG. | 7039 | 1.0 | NONE | | ST | 24 |
| 25 | 3.2" | 0 DEG. | 7039 | 1.0 | UNF. | 0.30 | ST | 24 |
| 26 | 3.2" | 0 DEG. | 7039 | 1.0 | AL 1100 | 0.19 | ST | 24 |
| 27 | 3.2" | JET X-RAY SHOT | | | | | | |
| 28 | 3.2" | JET X-RAY SHOT | | | | | | |
| 29 | 3.2" | JET X-RAY SHOT | | | | | | |
| 30 | TOW 11 | JET X-RAY SHOT | | | | | | |
| 31 | TOW 11 | JET X-RAY SHOT | | | | | | |
| 32 | TOW 11 | 0 DEG. | 7039 | 1.0 | F.F./ST | 5/.06 | ST | 24 |
| 33 | 3.2" | 0 DEG. | 5083 | 1.0 | BISQUE | 0.42 | ST | 24 |
| 34 | 3.2" | 0 DEG | 5083 | 1.0 | NONE | | ST | 24 |
| 35 | 3.2" | 0 DEG. | 5083 | 1.0 | AL 1100 | 0.19 | ST | 24 |
| 36 | 3.2" | 0 DEG. | 5083 | 1.0 | AL 1100 | 0.30 | ST | 24 |
| 37 | 3.2" | 0 DEG. | 7039 | 1.0 | ALP | 0.38 | ST | 24 |
| 38 | 3.2" | 0 DEG. | 7039 | 1.0 | F.F./liner | .5/.29 | ST | 24 |
| 39 | 3.2" | 0 DEG. | 7039 | 1.0 | ALP | 0.50 | ST | 24 |
| 40 | 105 mm | 0 DEG. | 7039 | 1.0 | AL 1100 | 0.32 | NONE | |
| 41 | 105 mm | 53 DEG. | 7039 | 1.0 | NONE | | ST | 24 |
| 42 | 105 mm | 53 DEG. | 7039 | 1.0 | ALP | 0.38 | ST | 24 |
| 43 | 105 mm | 0 DEG. | 7039 | 1.0 | ALP | 0.25 | ST | 24 |
| 44 | 105 mm | 0 DEG. | 5083 | 1.0 | ALP | 0.25 | ST | 24 |
| 45 | 105 mm | 0 DEG. | 5083 | 1.0 | ALP | 0.38 | ST | 24 |
| 46 | TOW 11 | 0 DEG. | 7039 | 1.0 | ALP | 0.38 | ST | 24 |
| 47 | 105 mm | 0 DEG. | 7039 | 1.5 | NONE | | ST | 24 |
| 48 | 105 mm | 0 DEG | 5083 | 1.5 | NONE | | ST | 24 |
| 49 | 105 mm | 0 DEG. | 7039 | 1.0 | F.F. | 0.25 | ST | 24 |
| 50 | 105 mm | 0 DEG. | 5083 | 1.0 | F.F. | 0.25 | ST | 24 |
| 51 | 105 mm | 0 DEG | 5083 | 1.0 | NONE | | ST | 24 |
| 52 | 105 mm | 0 DEG. | 7039 | 1.0 | NONE | | ST | 24 |
| 53 | 105 mm | 53 DEG. | 5083 | 1.0 | NONE | | ST | 24 |
| 54 | 105 mm | 53 DEG. | 5083 | 1.5 | NONE | | ST | 24 |
| 55 | 105 mm | 53 DEG. | 7039 | 1.5 | NONE | | ST | 24 |
| 56 | 105 mm | 53 DEG. | 7039 | 1.5 | F.F. | 0.50 | ST | 24 |
| 57 | 105 mm | 53 DEG. | 7039 | 1.5 | BISQUE | 0.59 | ST | 24 |
| 58 | 105 mm | 53 DEG. | 7039 | 1.5 | liner | 1.23 | ST | 24 |
| 59 | 105 mm | 53 DEG. | 7039 | 1.5 | SP'D liner | 0.73 | ST | 24 |
| 60 | 105 mm | 53 DEG. | 7039 | 1.5 | ALP | 0.40 | ST | 24 |

The spall backing material used in the tests included:

1. Unfired alumina
2. Bisque-fired alumina
3. Fully fired alumina
4. 1100 aluminum
5. ALP (an alumina-loaded epoxy);

The primary backing materials are either readily commercially available or easily producable and are described in detail below.

Fully-fired alumina—density: 3.46 g/cc or 17.9 PSF per inch of thickness. This material was procured as 87% pure alumina. This is a fully-dense alumina, marketed for wear resistant applications. Plates and hexagonal tiles were used. The plates were nominally 6"×4"×½" or 4"×4"×½". The hex tiles, ⅞" across the flats and ⅜" thick, were supplied bonded to a plastic net in 6"×6" sections.

Unfired alumina—density: 2.18 g/cc or 11.3 PSF per inch of thickness. This material is of the same composition as the fully-fired alumina. The unfired alumina is not used for any commercial application, being a fully-fired alumina body in an intermediate state of manufacture. The unfired body consists of a micron range powder pressed into a compact plate with an organic binder (generally about 2%).

Bisque-fired alumina—density: 2.07 g/cc or 10.7 PSF per inch of thickness. Similar to the unfired alumina, this material is a body in what would typically be an intermediate stage of manufacture. The bisque firing is done at a relatively low temperature, which first burns off the organic binder, and then bonds the alumina particulates by melting the glass components in the powder.

1100 aluminum—density: 2.71 g/cc or 14.0 PSF per inch of thickness. This aluminum alloy was selected as one having matching Impedance to the aluminum armor, but with high ductility and elongation to failure. Additionally, this is a very pure alloy of a minimum of 99% aluminum. The high purity eliminates most of the second phase particles associated with high strength aluminum alloys, which have been identified in some research as being nucleation sites for spall cracks. It was anticipated that this high purity alloy might then be less spall prone than the high strength 5083 and 7039 alloys.

Alumina-loaded polymer (ALP)—density: 2.05 g/cc or 10.6 PSF per inch of thickness.

ALP, a readily available commercial material, was tested and is a wear resistant coating material consisting of a 70% by weight concentration of alumina beads suspended in an epoxy resin. The beads are of an 87%. Particle analysis shows that the beads have an average particle size of about 440 microns. Particles are porous and polycrystaline, with micron-size alpha alumina crystalites in a glass matrix.

As indicated in Table 3, the majority of ballistic tests were made with 7039 aluminum armor alloy since it is considerably more spall prone than 5083 aluminum armor alloy which was also tested. The angle of attack or obliguities were usually perpendicular to the outer wall of the test target which is indicated at 0° in Table 3 although several tests were made at 53°. The thickness of the armor targets was usually 1 inch although several tests were made with targets that were 1.5 inches thick. The aluminum armor alloys were of armor specification; MIL-A-46027G (MR) for 5083 aluminum, and MIL-A-46063F for 7039 aluminum.

Four shots 21, 38, 58 and 59 of Table 3 were made against base line conventional spall liner (Kevlar) systems for comparison purposes. Shots 21 and 38 were made with the spall liner panels clamped directly to the armor plate, shot 58 had the liner panel spaced four inches off the back of the armor plate, and shot 59 was made with the liner panel as a secondary backing material layer behind a layer of fully fired alumina.

A basic premise of the several preferred types of backing material is that the backing material works best when in direct or contiguous contact with the interior of the armor plate, whereas tests indicate that conventional spall liners require a stand-off space to work efficiently. When a conventional spall liner is used in contact with the armor plate, it has been found that a considerably thicker, and thus a weight penalty, is required to achieve the same performance. The weight of the conventional liners for shot No. 58 was 8 pounds per square foot consisting of two layers, whereas shot No. 59 consisting of a single panel spaced four inches from the back of the armor plate weighed four pounds per square foot.

Tests 1, 2 and 3 were the only tests conducted against a steel armor. These tests were conducted against the known steel armor identified as RHA steel armor (per MIL-A-12560) and significantly reduced the spall from shaped charge penetration of the steel.

Before each of the above tests were conducted when using armor plate with fully fired, unfired and bisque-fired aluminas, or the 1100 aluminum, the mating surfaces of the armor plate and the backing material were thoroughly cleaned and flattened using sand paper or the like, and an appropriate amount of epoxy was mixed and evenly applied to the backing plate and attached to the armor plate in a manner which eliminated all air pockets therefrom. The panels were then allowed to cure for fifteen minutes.

The procedure for applying alumina loaded epoxy to the armor was similar except that the alumina loaded epoxy was mixed at a ratio of 1 part by volume of hardener to 16 parts of powdered resin/alumina paste. One gallon of the mix covered 6 targets with a ⅜ inch thick section. This mixture was then placed in plywood molds on the armor plate and pressed flat with a 12"×12" metal plate having waxed paper between the plate and the mixture. The plate is then slid off the mixture and the mixture is secured overnight at a temperature above 60° F.

The following warheads used during the test were not production rounds but were rounds rejected for minor-out-of specification conditions.

1. TOW II Simulants
2. BRL 3.2" Simulants
3. 105 mm (In production form known as M456 Heat rounds)

The above warheads are all of the shaped charge type which produce a slug in addition to a jet. The slug forms from the cone material which remains after the jet forms and has significant mass and velocity and may pass through the armor plate and backing.

During the ballistic test, the armor plate 20 and backing material 40 bonded thereto were clamped to the front face of the rigid 3" steel test stand 52 (FIG. 3) to which an 18" or 24" square armor plate 20 is clamped with the backing material 40 projecting into an elipitical cut-out 53 in the steel test stand 52. Witness sheets 54 are clamped to a frame 56 which is parallel to the test stand 52 and is 24" square for the 0° obliguity shots and 4'×8' for the 53° obliguity shots. As illustrated in Table 3, aluminum witness sheets 54 were used in most of the early tests having a thickness of 20 mill's. In later tests 24 mill soft steel sheets were used because the aluminum witness plates would deform excessively and it was desired to more closely differentiate between lethal and nonlethal spall. The witness sheets were supported by two ⅜" plywood sheets (not shown).

In an initial test conducted with a TOW II warhead the impact of the slug tore a large hole in the target plate 20 and broke it in half. In order to overcome this problem, a steel stripper plate 58 (FIG. 3) with a 2 ½" diameter hole 60 therein was placed between the warhead and the witness sheet to prevent the slug from impacting the witness sheet. The hole in the stripper plate 58 was subsequently decreased in size to 1 ¾" since the larger hole was not consistently stopping the slug. Even the smaller hole was insufficient to eliminate the slug impact damage completely.

Ballistic Tests And Conclusions

Ballistic tests were conducted specifically in regard to three functions; the primary function being to suppress spall in the armor plate, the second function being the production of nonlethal fragments from the spall backing material itself, and the third function being the evaluation of the effect of different types of spall backing material on the jet penetration process from spaced charge warheads. The results of the tests were expedited by photographing the front and back of each target and the front of each witness sheet with back lighting. The many photographs were then easily compared to determine which backing materials and thicknesses were most effective to prevent or minimize lethal spall from the armor and nonlethal spall from the backing material.

In comparing the witness sheets from unbacked targets and targets backed with spall backing material, the witness sheets from unbacked targets shot at 0° obliguity typically exhibited two features; a central region of perforations caused by the passage of the jet from a spaced charge, and surrounding this, a generally circlar distribution of perforations as illustrated in FIG. 7B from 105 mm shot 48. FIG. 7A illustrates the back of the target and the zone from which spall was released. The specifics of the shot are given in Table 4.

Figure 8A:
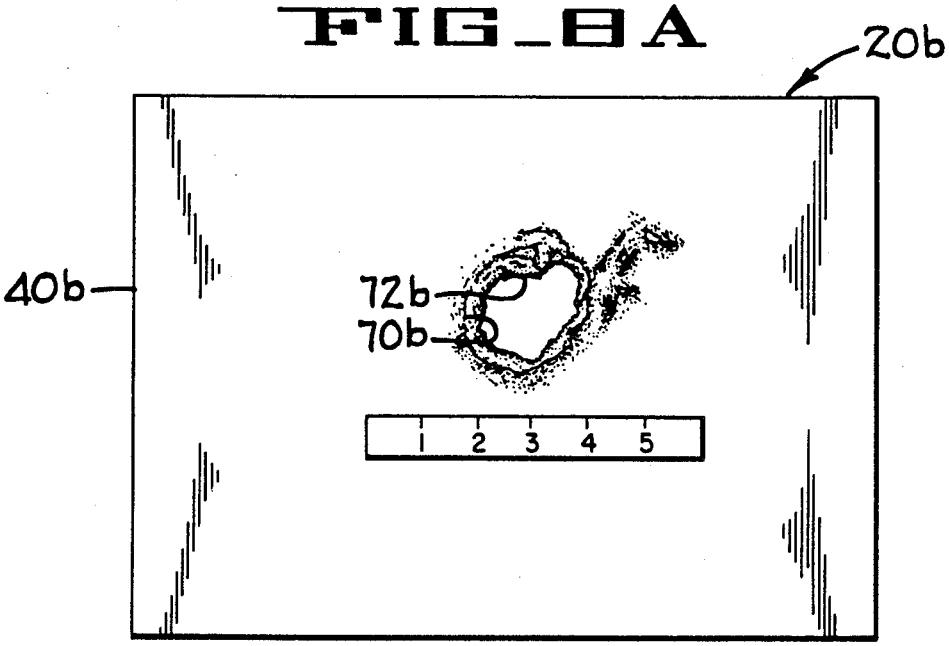
FIG. 8A is a copy of a photograph illustrating the back of an armor test plate for shot 13 (see table 3) with a fully fixed alumina spall backing illustrating the area from which armor spall has been released.
Figure 8B:
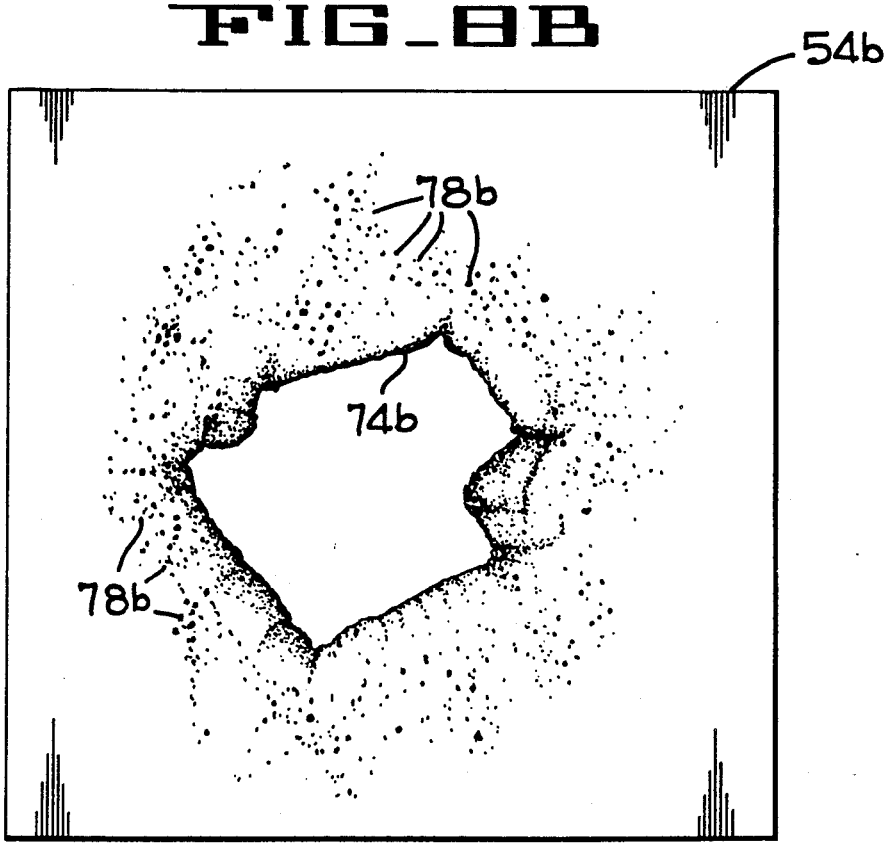
FIG. 8B is a copy of a photograph illustrating the front of the witness plate for shot 13 illustrating a large hole from the slug of the shaped charge liner and a minor spall ring surrounding the slug hole.

The witness sheets and target from oblique shots of unbacked targets exhibit three features; the jet penetration region, a lobe of penetration in the plane of the jet, and an arc of penetration around the jet zone. FIG. 8A illustrates the back of the armor plate from which spall has been released. FIG. 8B illustrates the witness plate from 105 mm shot 13 with the jet penetration hole and the arc of penetration of the armor spall being shown. The numerical data of all tests in which witness plates were used is shown in Table 4 with the identification number, i.e., shot No., corresponding to those in Table 3.

TABLE 4

TARGET AND WITNESS DATA

| ID NO. | WAR HEAD | OBL. | TARGET MTL. | TARGET THK. | BACKING MATERIAL MTL. | BACKING MATERIAL THK. | WITNESS MTL. | WITNESS THK. | FRONT SPALL DIA | PEN. HOLE DIA | REAR SPALL DIA | FRONT SPALL DEPTH | REAR SPALL DEPTH | 99% SPALL DIA | HOLE VOL. | BACK SPALL VOL. | FRONT SPALL VOL. |
|---|---|---|---|---|---|---|---|---|---|---|---|---|---|---|---|---|---|
| 04 | TOW II | 0 DEG. | 7039 | 1.0 | BISQUE | 0.44 | ST/ST | 59/59 | 4.51 | 2.76 | 3.96 | 0.44 | 0.27 | 40.00 | 5.98 | 1.71 | 4.40 |
| 05 | TOW II | 0 DEG. | 7039 | 1.0 | NONE | | AL/ST | 20/59 | 3.35 | 2.38 | 3.30 | 0.30 | 0.40 | 42.00 | 4.45 | 1.64 | 1.31 |
| 06 | TOW II | 0 DEG. | 5083 | 1.0 | NONE | | AL/ST | 20/59 | 3.45 | 2.25 | 3.18 | 0.30 | 0.36 | 48.00 | 3.98 | 1.43 | 1.61 |
| 07 | TOW II | 0 DEG. | 7039 | 1.0 | NONE | | AL/ST | 20/59 | 3.80 | 2.00 | 3.41 | 0.35 | 0.41 | 48.00 | 3.14 | 2.46 | 2.87 |
| 08 | TOW II | 0 DEG. | 7039 | 1.0 | NONE | | AL | 20 | 3.78 | 2.25 | 2.83 | 0.40 | 0.30 | 48.00 | 3.98 | 0.69 | 2.90 |
| 09 | TOW II | 0 DEG. | 7039 | 1.0 | BISQUE | 0.31 | AL | 20 | 3.82 | 2.43 | 3.41 | 0.51 | 0.44 | 46.00 | 4.64 | 1.98 | 3.48 |
| 10 | TOW II | 0 DEG. | 7039 | 1.0 | F.F. | 0.38 | AL | 20 | 3.10 | 1.63 | (1) | (2) | 0.30 | 40.00 | 2.09 | 0.25 | 0.00 |
| 11 | TOW II | 0 DEG. | 7039 | 1.0 | BISQUE | 0.44 | AL | 20 | 4.22 | 1.87 | 3.35 | 0.15 | 0.20 | 40.00 | 2.75 | 1.21 | 1.69 |
| 12 | TOW II | 0 DEG. | 7039 | 1.0 | BISQUE | 0.44 | AL | 20 | 1.45 | 1.45 | 3.75 | 0.00 | 0.18 | 40.00 | 1.65 | 1.69 | 0.00 |
| 13 | TOW II | 0 DEG. | 7039 | 1.0 | F.F | 0.50 | AL | 20 | 1.28 | 1.28 | (3) | 0.00 | (3) | 36.00 | 1.29 | 0.00 | 0.00 |
| 14 | TOW II | 0 DEG. | 7039 | 1.0 | BISQUE | 0.59 | AL | 20 | 3.30 | 2.57 | 3.74 | 0.34 | 0.31 | 42.00 | 5.19 | 1.80 | 1.14 |
| 15 | TOW II | 0 DEG. | 7039 | 1.0 | UNF. | 0.58 | AL | 20 | 3.42 | 1.77 | (4) | 0.23 | (4) | 34.00 | 2.46 | 0.09 | 1.55 |
| 16 | TOW II | 0 DEG. | 7039 | 1.0 | UNF. | 0.30 | AL | 20 | 4.08 | 2.58 | 3.79 | 0.34 | 0.27 | 36.00 | 5.23 | 1.63 | 2.67 |
| 17 | TOW II | 0 DEG. | 7039 | 1.0 | F.F. | 0.50 | AL | 20 | 3.65 | 1.91 | 2.92 | 0.33 | 0.30 | 31.00 | 2.87 | 1.15 | 2.51 |
| 18 | TOW II | 0 DEG. | 7039 | 1.0 | AL 1100 | 0.50 | AL | 20 | 1.35 | 1.35 | 0.00 | 0.00 | 0.00 | 37.00 | 1.43 | 0.00 | 0.00 |
| 19 | TOW II | 0 DEG. | 7039 | 1.0 | AL 1100 | 0.19 | ST | 24 | 3.76 | 1.77 | 2.61 | 0.28 | 0.28 | 39.00 | 2.46 | 0.81 | 2.42 |
| 20 | TOW II | 0 DEG. | 7039 | 1.0 | AL 1100 | .19/.19 | ST | 24 | 4.38 | 2.30 | (5) | 0.35 | 0.16 | 36.00 | 4.15 | 0.00 | 3.82 |
| 21 | TOW II | 0 DEG. | 7039 | 1.0 | liner | 1.38 | ST | 24 | 0.00 | 1.99 | 2.87 | 0.00 | (6) | 21.00 | 3.11 | 1.18 | 0.00 |
| 22 | 3.2" | 0 DEG. | 7039 | 1.0 | F.F. | 0.50 | ST | 24 | 0.00 | 1.20 | 2.20 | 0.00 | 0.31 | 26.00 | 1.13 | 0.83 | 0.00 |
| 23 | 3.2" | 0 DEG. | 7039 | 1.0 | BISQUE | 0.59 | ST | 24 | 0.00 | 1.16 | (7) | 0.00 | (8) | 35.00 | 1.06 | 0.03 | 0.00 |
| 24 | 3.2" | 0 DEG. | 7039 | 1.0 | NONE | | ST | 24 | 0.00 | 1.18 | 2.62 | 0.00 | 0.29 | 48.00 | 1.09 | 1.25 | 0.00 |
| 25 | 3.2" | 0 DEG. | 7039 | 1.0 | UNF. | 0.30 | ST | 24 | 0.00 | 1.13 | 1.85 | 0.00 | 0.25 | 30.00 | 1.00 | 0.42 | 0.00 |
| 26 | 3.2" | 0 DEG. | 7039 | 1.0 | AL 1100 | 0.19 | ST | 24 | 0.00 | 0.75 | 2.00 | 0.00 | 0.25 | 42.00 | 0.44 | 0.67 | 0.00 |
| 32 | TOW II | 0 DEG. | 7039 | 1.0 | F.F. liner | .5/.06 | ST | 24 | 3.88 | 2.06 | 3.00 | 0.37 | 0.30 | 37.00 | 3.33 | 1.12 | 3.14 |
| 33 | 3.2" | 0 DEG. | 5083 | 1.0 | BISQUE | 0.42 | ST | 24 | 0.00 | 1.98 | 3.39 | 0.00 | 0.26 | 18.00 | 3.09 | 1.51 | 0.00 |
| 34 | 3.2" | 0 DEG. | 5083 | 1.0 | NONE | | ST | 24 | 0.00 | 1.74 | 2.20 | 0.00 | 0.24 | 46.00 | 2.38 | 0.34 | 0.00 |
| 35 | 3.2" | 0 DEG. | 5083 | 1.0 | AL 1100 | 0.19 | ST | 24 | 0.00 | 1.44 | 2.34 | 0.00 | 0.18 | 38.00 | 1.63 | 0.47 | 0.00 |
| 36 | 3.2" | 0 DEG. | 5083 | 1.0 | AL 1100 | 0.30 | ST | 24 | 0.00 | 1.18 | 0.00 | 0.00 | 0.00 | 40.00 | 1.09 | 0.00 | 0.00 |
| 37 | 3.2" | 0 DEG. | 7039 | 1.0 | ALP | 0.38 | ST | 24 | 0.00 | 0.56 | 0.00 | 0.00 | 0.00 | 16.00 | 0.25 | 0.00 | 0.00 |
| 38 | 3.2" | 0 DEG. | 7039 | 1.0 | F.F. liner | .5/.29 | ST | 24 | 0.00 | 1.12 | 2.16 | 0.00 | 0.38 | 35.00 | 0.99 | 1.02 | 0.00 |
| 39 | 3.2" | 0 DEG. | 7039 | 1.0 | ALP | 0.50 | ST | 24 | 0.00 | 0.83 | 2.04 | 0.00 | 0.22 | 12.00 | 0.54 | 0.60 | 0.00 |
| 40 | 105 mm | 0 DEG. | 7039 | 1.0 | AL 1100 | 0.32 | ST | 24 | 0.00 | 1.10 | 1.81 | 0.00 | 0.18 | NA | 0.95 | 0.57 | 0.00 |
| 41 | 105 mm | 53 DEG. | 7039 | 1.0 | NONE | | ST | 24 | 2.64 | 1.56 | 2.41 | 0.45 | 0.15 | OBL | 1.91 | 0.40 | 1.60 |
| 42 | 105 mm | OBL | 7039 | 1.0 | ALP | 0.38 | ST | 24 | (10) | 1.60 | 2.19 | 0.22 | 0.17 | OBL | 2.01 | 0.40 | −0.44 |
| 43 | 105 mm | 0 DEG. | 7039 | 1.0 | ALP | 0.25 | ST | 24 | 0.00 | 0.82 | 0.00 | 0.00 | 0.00 | 39.00 | 0.53 | 0.00 | 0.00 |
| 44 | 105 mm | 0 DEG. | 5083 | 1.0 | ALP | 0.25 | ST | 24 | 0.00 | 0.84 | 0.00 | 0.00 | 0.00 | 32.00 | 0.55 | 0.00 | 0.00 |
| 45 | 105 mm | 0 DEG. | 5083 | 1.0 | ALP | 0.38 | ST | 24 | 0.00 | 0.92 | 0.00 | 0.00 | 0.00 | 35.00 | 0.66 | 0.00 | 0.00 |
| 46 | TOW II | 0 DEG. | 7039 | 1.0 | ALP | 0.38 | ST | 24 | 0.00 | 1.63 | 1.90 | 0.00 | 0.17 | 36.00 | 2.09 | 0.13 | 0.00 |
| 47 | 105 mm | 0 DEG. | 7039 | 1.5 | NONE | | ST | 24 | 0.00 | 1.00 | 2.61 | 0.00 | 0.29 | 48.00 | 0.78 | 1.33 | 0.00 |
| 48 | 105 mm | 0 DEG. | 5083 | 1.5 | NONE | | ST | 24 | 0.00 | 1.08 | 2.63 | 0.00 | 0.23 | 48.00 | 0.92 | 1.04 | 0.00 |
| 49 | 105 mm | 0 DEG. | 7039 | 1.0 | F.F. | 0.25 | ST | 24 | 0.00 | 0.79 | 1.38 | 0.00 | 0.20 | 30.00 | 0.49 | 0.20 | 0.00 |
| 50 | 105 mm | 0 DEG. | 5083 | 1.0 | F.F. | 0.25 | ST | 24 | 0.00 | 0.90 | 0.00 | 0.00 | 0.00 | 29.00 | 0.64 | 0.00 | 0.00 |
| 51 | 105 mm | 0 DEG. | 5083 | 1.0 | NONE | | ST | 24 | 0.00 | 0.96 | 1.89 | 0.00 | 0.19 | 43.00 | 0.72 | 0.40 | 0.00 |
| 52 | 105 mm | 0 DEG. | 7039 | 1.0 | NONE | | ST | 24 | 0.00 | 0.70 | 1.91 | 0.00 | 0.29 | 44.00 | 0.38 | 1.60 | 0.00 |
| 53 | 105 mm | 53 DEG. | 5083 | 1.0 | NONE | | ST | 24 | (13) | 1.56 | 2.17 | 0.30 | 0.24 | OBL | 1.91 | 0.43 | −0.57 |
| 54 | 105 mm | 53 DEG. | 5083 | 1.5 | NONE | | ST | 24 | (14) | 1.80 | 2.82 | 0.51 | 0.42 | OBL | 2.54 | 1.55 | −1.30 |
| 55 | 105 mm | 53 DEG. | 7039 | 1.5 | NONE | | ST | 24 | (15) | 1.78 | 4.42 | 0.33 | 0.41 | OBL | 2.49 | 5.27 | −0.82 |
| 56 | 105 mm | 53 DEG. | 7039 | 1.5 | F.F. | 0.50 | ST | 24 | (16) | 1.84 | 0.00 | 0.38 | 0.00 | OBL | 2.66 | 0.00 | −1.01 |

TABLE 4-continued

| ID NO. | WAR HEAD | OBL. | TARGET MTL. | TARGET THK. | BACKING MATERIAL MTL. | BACKING MATERIAL THK. | WITNESS MTL. | WITNESS THK. | FRONT SPALL DIA | PEN. HOLE DIA | REAR SPALL DIA | FRONT SPALL DEPTH | REAR SPALL DEPTH | 99% SPALL DIA | HOLE VOL. | BACK SPALL VOL. | FRONT SPALL VOL. |
|---|---|---|---|---|---|---|---|---|---|---|---|---|---|---|---|---|---|
| | | | TARGET AND WITNESS DATA | | | | | | | | | | | | | | |
| 57 | 105 mm | 53 DEG. | 7039 | 1.5 | BISQUE | 0.59 | ST | 24 | (17) | 2.22 | (18) | 0.39 | 0.22 | OBL | 3.87 | 0.32 | −1.51 |
| 58 | 105 mm | 53 DEG. | 7039 | 1.5 | liner | 1.23 | ST | 24 | (19) | 1.86 | 2.49 | 0.47 | 0.23 | OBL | 2.72 | 0.28 | −1.28 |
| 59 | 105 mm | 53 DEG. | 7039 | 1.5 | SP'D liner | 0.73 | ST | 24 | (21) | 1.94 | 2.70 | 0.47 | 0.28 | OBL | 2.96 | 2.58 | −1.39 |
| 60 | 105 mm | 53 DEG. | 7039 | 1.5 | ALP | 0.40 | ST | 24 | (23) | 1.90 | 2.69 | 0.41 | 0.23 | OBL | 2.84 | 1.46 | −1.16 |

NOTES: ( ) FOR TABLE 4
(A) ALL DIMENSIONS IN INCHES OR CUBIC INCHES
(1) 3.0" OVER A 60 DEG. ARC
(2) 0.29" DEEP OVER 180 DEG. ARC
(3) ¼" SEGMENT
(4) VOLUME = ¼" × ⅛" × ¾"
(5) SLUG MAY HAVE DESTROYED SPALL CONE
(6) INDISTINCT SPALL RING APPRX. 0.35" DEEP
(7) 1.4" OVER 90 DEG. ARC
(8) 0.25" DEEP OVER 90 DEG. ARC
(9) 1.81" OVER 180 DEG., PROBABLY FROM SLUG
(10) 3.00" DIA OVER 200 DEG.
(11) 2.19" DIA OVER 120 DEG.
(12) .191" DIA OVER 200 DEG.
(13) .35" × 4" OVER 180 DEG.
(14) .66" × 2.03" OVER 70 DEG.
(15) 4.19" DIA OVER 330 DEG.
(16) 4.19" DIA OVER 210 DEG.
(17) 3.56" DIA OVER 250 DEG.
(18) .53" WIDE × 2.66" LONG
(19) 3.57" DIA OVER 200 DEG.
(20) 50 DEG. ARC .63" WIDE
(21) 3.93" DIA OVER 330 DEG.
(22) 2.70" DIA OVER 300 DEG.
(23) 3.57 DIA OVER 200 DEG.
(24) 2.69" DIA OVER 200 DEG.
(25) LINER PANELS ARE CLAMPED TO TARGET EXCEPT FOR NO. 58 WHICH IS SPACED

DATA EVALUATION

The data was evaluated in regard to the intended functions of the spall backing material which is the suppression of spall forming in the armor plate material, and the production of nonlethal fragments from the spall backing materials. While no one material was demonstrated to be best in all cases, definite trends in performance were observed that are linked to the different materials. These trends are as follows:

Impedance Matching

The tests with 1100 aluminum demonstrated its ability to completely suppress the formation of spall in the armor plate. Since the spall strength is the stress level at which void nucleation occurs prior to spall fracture, and since the impedance of the aluminum backing material was equal to that of the armor material spallation will not occur.

Effect of Thickness

It was observed that there is a limited thickness of the spall backing material below which the backing system will not function. For instance, while the 1100 aluminum backing material at 0.5" thick completely eliminated the formation of spall, a 0.19" layer allowed spall to form in the armor plate.

Interaction With Jet Penetration

The nature of the damage to the witness sheet from the targets backed by ceramic materials is different from the others. Much of the damage to the witness sheet from the ceramic targets appeared as "burn holes" which generally exhibited a blackened, raised edge on both the front and rear of the witness plates. The perforations holes in the unbacked or aluminum-backed targets are irregular in shape and have a lip surrounding the hole only on the exit side. A steel plate in Test No. 49 gave indications that particles causing the burn holes are both copper and aluminum. It is assumed that the copper jet tip and the target material (aluminum) were entrained in the jet as it is discharged from the armor plate and is dispersed by the ceramic materials.

Effect of Backing Material Strength on Jet Penetration:

Burn holes occurred from all of the ceramic-backed targets except for the first two ALP targets in tests 37 and 39. The ALP on these two targets had mistakenly been made with less than the specific amount of the hardener, reducing the bond strength of the epoxy compared to the fully cured material. Witness sheets from later fully cured ALP samples exhibited burn holes. In addition, the witness sheets from the fully fired alumina-backed samples generally showed a greater density and distribution of the burn holes than did those from the unfired or bisque-fired alumina-backed samples. The indication is that higher strength in a ceramic system tends to increase the interaction with the jet.

Effect On Penetration Hole Volume

Table 5 shows a break down of he tests grouped into those of similar warhead, armor type, and obliguity, and then ranked according to increasing penetration hole volume. For the 0° obliguity tests, the addition of the backing material generally leads to a significant decrease in the penetration hole volume compared to unbacked targets. The ALP material was an anomaly in its unusually good performance in the 3.2" weapon tests.

TABLE 5

Target ranking according to target penetration hole volume.

| ID NO. | WAR HEAD | OBL. | TARGET MTL. | TARGET THK. | BACKING MATERIAL MTL. | BACKING MATERIAL THK. | WITNESS MTL. | 99% SPALL DIA. | PEN. HOLE VOL. | BACK SPALL VOL. |
|---|---|---|---|---|---|---|---|---|---|---|
| 13 | TOW II | 0 DEG. | 7039 | 1.00 | F.F. | 0.50 | AL | 36.00 | 1.29 | 0.00 |
| 18 | TOW II | 0 DEG. | 7039 | 1.00 | AL 1100 | 0.50 | AL | 37.00 | 1.43 | 0.00 |
| 12 | TOW II | 0 DEG. | 7039 | 1.00 | BISQUE | 0.44 | AL | 40.00 | 1.65 | 1.69 |
| 46 | TOW II | 0 DEG. | 7039 | 1.00 | ALP | 0.38 | ST | 36.00 | 2.09 | 0.13 |
| 10 | TOW II | 0 DEG. | 7039 | 1.00 | F.F. | 0.38 | AL | 40.00 | 2.09 | 0.25 |
| 15 | TOW II | 0 DEG. | 7039 | 1.00 | UNF. | 0.58 | AL | 34.00 | 2.46 | 0.09 |
| 19 | TOW II | 0 DEG. | 7039 | 1.00 | AL 1100 | 0.19 | ST | 39.00 | 2.46 | 0.81 |
| 11 | TOW II | 0 DEG. | 7039 | 1.00 | BISQUE | 0.44 | AL | 40.00 | 2.75 | 1.21 |
| 17 | TOW II | 0 DEG. | 7039 | 1.00 | F.F. | 0.50 | AL | 31.00 | 2.87 | 1.15 |
| 21 | TOW II | 0 DEG. | 7039 | 1.00 | Liner | 1.38 | ST | 21.00 | 3.11 | 1.18 |
| 07 | TOW II | 0 DEG. | 7039 | 1.00 | NONE | | AL/ST | 48.00 | 3.14 | 2.46 |
| 32 | TOW II | 0 DEG. | 7039 | 1.00 | F.F./ST | .5/.06 | ST | 37.00 | 3.33 | 1.12 |
| 08 | TOW II | 0 DEG. | 7039 | 1.00 | NONE | | AL | 48.00 | 3.98 | 0.69 |
| 20 | TOW II | 0 DEG. | 7039 | 1.00 | AL 1100 | .19/.19 | ST | 36.00 | 4.15 | 0.00 |
| 05 | TOW II | 0 DEG. | 7039 | 1.00 | NONE | | AL/ST | 42.00 | 4.45 | 1.64 |
| 09 | TOW II | 0 DEG. | 7039 | 1.00 | BISQUE | 0.31 | AL | 46.00 | 4.64 | 1.98 |
| 14 | TOW II | 0 DEG. | 7039 | 1.00 | BISQUE | 0.59 | AL | 42.00 | 5.19 | 1.80 |
| 16 | TOW II | 0 DEG. | 7039 | 1.00 | UNF. | 0.30 | AL | 36.00 | 5.23 | 1.63 |
| 04 | TOW II | 0 DEG. | 7039 | 1.00 | BISQUE | 0.44 | ST/ST | 40.00 | 5.98 | 1.71 |
| 06 | TOW II | 0 DEG. | 5083 | 1.00 | NONE | | AL/ST | 48.00 | 3.98 | 1.43 |
| 37 | 3.2" | 0 DEG. | 7039 | 1.00 | ALP | 0.38 | ST | 16.00 | 0.25 | 0.00 |
| 26 | 3.2" | 0 DEG. | 7039 | 1.00 | AL 1100 | 0.19 | ST | 42.00 | 0.44 | 0.67 |
| 39 | 3.2" | 0 DEG. | 7039 | 1.00 | AL | 0.50 | ST | 12.00 | 0.54 | 0.60 |
| 38 | 3.2" | 0 DEG. | 7039 | 1.00 | F.F./liner | .5/.29 | ST | 35.00 | 0.99 | 1.02 |
| 25 | 3.2" | 0 DEG. | 7039 | 1.00 | UNF. | 0.30 | ST | 30.00 | 1.00 | 0.42 |
| 23 | 3.2" | 0 DEG. | 7039 | 1.00 | BISQUE | 0.59 | ST | 35.00 | 1.06 | 0.03 |
| 24 | 3.2" | 0 DEG. | 7039 | 1.00 | NONE | | ST | 48.00 | 1.09 | 1.25 |
| 22 | 3.2" | 0 DEG. | 7039 | 1.00 | F.F. | 0.50 | ST | 26.00 | 1.13 | 0.83 |
| 36 | 3.2" | 0 DEG. | 5083 | 1.00 | AL 1100 | 0.30 | ST | 40.00 | 1.09 | 0.00 |
| 35 | 3.2" | 0 DEG. | 5083 | 1.00 | AL 1100 | 0.19 | ST | 38.00 | 1.63 | 0.47 |
| 34 | 3.2" | 0 DEG. | 5083 | 1.00 | NONE | | ST | 46.00 | 2.38 | 0.34 |
| 33 | 3.2" | 0 DEG. | 5083 | 1.00 | BISQUE | 0.42 | ST | 18.00 | 3.09 | 1.51 |
| 55 | 105 mm | 53 DEG. | 7039 | 1.50 | NONE | | ST | OBL | 2.49 | 5.27 |
| 56 | 105 mm | 53 DEG. | 7039 | 1.50 | F.F. | 0.50 | ST | OBL | 2.66 | 0.00 |

TABLE 5-continued

Target ranking according to target penetration hole volume.

| ID NO. | WAR HEAD | OBL. | TARGET MTL. | TARGET THK. | BACKING MATERIAL MTL. | BACKING MATERIAL THK. | WITNESS MTL. | 99% SPALL DIA. | PEN. HOLE VOL. | BACK SPALL VOL. |
|---|---|---|---|---|---|---|---|---|---|---|
| 58 | 105 mm | 53 DEG. | 7039 | 1.50 | Liner | 1.23 | ST | OBL | 2.72 | 0.28 |
| 60 | 105 mm | 53 DEG. | 7039 | 1.50 | ALP | 0.40 | ST | OBL | 2.84 | 1.46 |
| 59 | 105 mm | 53 DEG. | 7039 | 1.50 | SP'D Liner | 0.73 | ST | OBL | 2.96 | 2.58 |
| 57 | 105 mm | 53 DEG. | 7039 | 1.50 | BISQUE | 0.59 | ST | OBL | 3.87 | 0.31 |
| 54 | 105 mm | 53 DEG. | 5083 | 1.50 | NONE | | ST | OBL | 2.54 | 1.55 |
| 53 | 105 mm | 53 DEG. | 5083 | 1.00 | NONE | | ST | OBL | 1.91 | 0.43 |
| 41 | 105 mm | 53 DEG. | 7039 | 1.00 | NONE | | ST | OBL | 1.91 | 0.40 |
| 42 | 105 mm | 53 DEG. | 7039 | 1.00 | ALP | 0.38 | ST | OBL | 2.01 | 0.40 |
| 48 | 105 mm | 0 DEG. | 5083 | 1.50 | NONE | | ST | 48.00 | 0.92 | 1.04 |
| 44 | 105 mm | 0 DEG. | 5083 | 1.00 | ALP | 0.25 | ST | 32.00 | 0.55 | 0.00 |
| 50 | 105 mm | 0 DEG. | 5083 | 1.00 | F.F. | 0.25 | ST | 29.00 | 0.64 | 0.00 |
| 45 | 105 mm | 0 DEG. | 5083 | 1.00 | ALP | 0.38 | ST | 35.00 | 0.66 | 0.00 |
| 51 | 105 mm | 0 DEG. | 5083 | 1.00 | NONE | | ST | 43.00 | 0.72 | 0.40 |
| 47 | 105 mm | 0 DEG. | 7039 | 1.50 | NONE | | ST | 8.00 | 0.78 | 1.33 |
| 52 | 105 mm | 0 DEG. | 7039 | 1.00 | NONE | | ST | 44.00 | 0.38 | 1.60 |
| 49 | 105 mm | 0 DEG. | 7039 | 1.00 | F.F. | 0.25 | ST | 30.00 | 0.49 | 0.20 |
| 43 | 105 mm | 0 DEG. | 7039 | 1.00 | ALP | 0.25 | ST | 39.00 | 0.53 | 0.00 |
| 40 | 105 mm | 0 DEG. | 7039 | 1.00 | AL 1100 | 0.32 | ST | NA | 0.95 | 0.57 |

Effect on Spall Volume

Table 8 is similar to Table 7 except that the tests are ranked in order of increasing spall volume. In many cases it can be seen that the ALP, fully fired alumina and 1100 aluminum completely suppressed formation of spall. Even when the spall was not fully suppressed these materials performed consistently better than the unfired or bisque-fired aluminas. This is not an unexpected result in that the materials rank in order of their known or expected impedance values.

TABLE 6

Target ranking according to spall ring volume.

| ID NO. | WAR HEAD | OBL. | TARGET MTL. | TARGET THK. | BACKING MATERIAL MTL. | BACKING MATERIAL THK. | WITNESS MTL. | 99% SPALL DIA. | PEN. HOLE VOL. | BACK SPALL VOL. |
|---|---|---|---|---|---|---|---|---|---|---|
| 20 | TOW II | 0 DEG. | 7039 | 1.00 | AL 1100 | .19/.1 | ST | 36.00 | 4.15 | 0.00 |
| 13 | TOW II | 0 DEG. | 7039 | 1.00 | F.F. | 0.50 | AL | 36.00 | 1.29 | 0.00 |
| 18 | TOW II | 0 DEG. | 7039 | 1.00 | AL 1100 | 0.50 | AL | 37.00 | 1.43 | 0.00 |
| 15 | TOW II | 0 DEG. | 7039 | 1.00 | UNF. | 0.58 | AL | 34.00 | 2.46 | 0.09 |
| 46 | TOW II | 0 DEG. | 7039 | 1.00 | ALP | 0.38 | ST | 36.00 | 2.09 | 0.13 |
| 10 | TOW II | 0 DEG. | 7039 | 1.00 | F.F. | 0.38 | AL | 40.00 | 2.09 | 0.25 |
| 08 | TOW II | 0 DEG. | 7039 | 1.00 | NONE | | AL | 48.00 | 3.98 | 0.69 |
| 19 | TOW II | 0 DEG. | 7039 | 1.00 | AL 1100 | 0.19 | ST | 39.00 | 2.46 | 0.81 |
| 32 | TOW II | 0 DEG. | 7039 | 1.00 | F.F./ST | .5/.06 | ST | 37.00 | 3.33 | 1.12 |
| 17 | TOW II | 0 DEG. | 7039 | 1.00 | F.F. | 0.50 | AL | 31.00 | 2.87 | 1.15 |
| 21 | TOW II | 0 DEG. | 7039 | 1.00 | Liner | 1.38 | ST | 21.00 | 3.11 | 1.18 |
| 11 | TOW II | 0 DEG. | 7039 | 1.00 | BISQUE | 0.44 | AL | 40.00 | 2.75 | 1.21 |
| 16 | TOW II | 0 DEG. | 7039 | 1.00 | UNF. | 0.30 | AL | 36.00 | 5.23 | 1.63 |
| 05 | TOW II | 0 DEG. | 7039 | 1.00 | NONE | | AL/ST | 42.00 | 4.45 | 1.64 |
| 12 | TOW II | 0 DEG. | 7039 | 1.00 | BISQUE | 0.44 | AL | 40.00 | 1.65 | 1.69 |
| 04 | TOW II | 0 DEG. | 7039 | 1.00 | BISQUE | 0.44 | ST/ST | 40.00 | 5.98 | 1.71 |
| 14 | TOW II | 0 DEG. | 7039 | 1.00 | BISQUE | 0.59 | AL | 42.00 | 5.19 | 1.80 |
| 09 | TOW II | 0 DEG. | 7039 | 1.00 | BISQUE | 0.31 | AL | 46.00 | 4.64 | 1.98 |
| 07 | TOW II | 0 DEG. | 7039 | 1.00 | NONE | | AL/ST | 48.00 | 3.14 | 2.46 |
| 06 | TOW II | 0 DEG. | 5083 | 1.00 | NONE | | AL/ST | 48.00 | 3.98 | 1.43 |
| 37 | 3.2" | 0 DEG. | 7039 | 1.00 | ALP | 0.38 | ST | 16.00 | 0.25 | 0.00 |
| 23 | 3.2" | 0 DEG. | 7039 | 1.00 | BISQUE | 0.59 | ST | 35.00 | 1.06 | 0.03 |
| 25 | 3.2" | 0 DEG. | 7039 | 1.00 | UNF. | 0.30 | ST | 30.00 | 1.00 | 0.42 |
| 39 | 3.2" | 0 DEG. | 7039 | 1.00 | ALP | 0.50 | ST | 12.00 | 0.54 | 0.60 |
| 26 | 3.2" | 0 DEG. | 7039 | 1.00 | AL 1100 | 0.19 | ST | 42.00 | 0.44 | 0.67 |
| 22 | 3.2" | 0 DEG. | 7039 | 1.00 | F.F. | 0.50 | ST | 26.00 | 1.13 | 0.83 |
| 38 | 3.2" | 0 DEG. | 7039 | 1.00 | F.F./Liner | .5/.29 | ST | 35.00 | 0.99 | 1.02 |
| 24 | 3.2" | 0 DEG. | 7039 | 1.00 | NONE | | ST | 48.00 | 1.09 | 1.25 |
| 36 | 3.2" | 0 DEG. | 5083 | 1.00 | AL 1100 | 0.30 | ST | 40.00 | 1.09 | 0.00 |
| 34 | 3.2" | 0 DEG. | 5083 | 1.00 | NONE | | ST | 46.00 | 2.38 | 0.34 |
| 35 | 3.2" | 0 DEG. | 5083 | 1.00 | AL 1100 | 0.19 | ST | 38.00 | 1.63 | 0.47 |
| 33 | 3.2" | 0 DEG. | 5083 | 1.00 | BISQUE | 0.42 | ST | 18.00 | 3.09 | 1.51 |
| 56 | 105 mm | 53 DEG. | 7039 | 1.50 | F.F. | 0.50 | ST | OBL | 2.66 | 0.00 |
| 58 | 105 mm | 53 DEG. | 7039 | 1.50 | Liner | 1.23 | ST | OBL | 2.72 | 0.28 |
| 57 | 105 mm | 53 DEG. | 7039 | 1.50 | BISQUE | 0.59 | ST | OBL | 3.87 | 0.31 |
| 60 | 105 mm | 53 53 DEG. | 7039 | 150 | ALP | 0.40 | ST | DBL | 2.84 | 1.46 |
| 59 | 105 mm | 53 DEG. | 7039 | 1.50 | SP'D Liner | 0.73 | ST | OBL | 2.96 | 2.58 |
| 55 | 105 mm | 53 DEG. | 7039 | 1.50 | NONE | | ST | OBL | 2.49 | 5.27 |
| 54 | 105 mm | 53 DEG. | 5083 | 1.50 | NONE | | ST | OBL | 2.54 | 1.55 |
| 53 | 105 mm | 53 DEG. | 5083 | 1.00 | NONE | | ST | OBL | 1.91 | 0.43 |
| 41 | 105 mm | 53 DEG. | 7039 | 1.00 | NONE | | ST | OBL | 1.91 | 0.40 |
| 42 | 105 mm | 53 DEG. | 7039 | 1.00 | ALP | 0.38 | ST | OBL | 2.01 | 0.40 |

TABLE 6-continued

| ID NO. | WAR HEAD | OBL. | Target ranking according to spall ring volume. TARGET MTL. | TARGET THK. | BACKING MATERIAL MTL. | BACKING MATERIAL THK. | WITNESS MTL. | 99% SPALL DIA. | PEN. HOLE VOL. | BACK SPALL VOL. |
|---|---|---|---|---|---|---|---|---|---|---|
| 48 | 105 mm | 0 DEG. | 5083 | 1.50 | NONE | | ST | 48.00 | 0.92 | 1.04 |
| 50 | 105 mm | 0 DEG. | 5083 | 1.00 | F.F. | 0.25 | ST | 29.00 | 0.64 | 0.00 |
| 44 | 105 mm | 0 DEG. | 5083 | 1.00 | ALP | 0.25 | ST | 32.00 | 0.55 | 0.00 |
| 45 | 105 mm | 0 DEG. | 5083 | 1.00 | ALP | 0.38 | ST | 35.00 | 0.66 | 0.00 |
| 51 | 105 mm | 0 DEG. | 5083 | 1.00 | NONE | | ST | 43.00 | 0.72 | 0.40 |
| 47 | 105 mm | 0 DEG. | 7039 | 1.50 | NONE | | ST | 48.00 | 0.78 | 1.33 |
| 43 | 105 mm | 0 DEG. | 7039 | 1.00 | ALP | 0.25 | ST | 39.00 | 0.53 | 0.00 |
| 49 | 105 mm | 0 DEG. | 7039 | 1.00 | F.F. | 0.25 | ST | 30.00 | 0.49 | 0.20 |
| 40 | 105 mm | 0 DEG. | 7039 | 1.00 | AL 1100 | 0.32 | ST | NA | 0.95 | 0.57 |
| 52 | 105 mm | 0 DEG. | 7039 | 1.00 | NONE | | ST | 44.00 | 0.38 | 1.60 |

Effect on the 99% Spall Diameter

Table 9, again similar to Table 5, ranks the tests according to the diameter containing 99% of the spall damage on the witness sheet. It should first be noted that this diameter actually includes all of the damage to the witness whether from armor spall, backing material fragments, or jet particles. Again the ALP and fully-fired alumina are noted to be the most consistent performers, the ALP the more notable of the two. The unfired alumina also exhibited good performance. The very good performance of the fully-fired alumina was somewhat unexpected since its strength and density are so much higher than the unfired and bisque-fired materials. The reason for the results may be that the higher strength allowed more strain energy to be stored prior to failure. This energy would then be released in the formation of more surface (therefore more fragments of smaller size). This is seen in flexure testing of ceramics where materials with higher strength tend to break up into more fragments than those with lower strength.

Overall Performance For 0° Obliquity

Against all rounds tested the material which has been most effective in suppressing lethal spall is ALP. This material was exceptional in all aspects against a 3.2" warhead. Against the other heads it showed a very good performance. The other resin matrix backing materials tested well when fully cured.

Although the spall backing material used in a ballistic test included only ALP; fully-fired, bisque-fired, and unfired alumina; and 1100 aluminum at the thicknesses set forth in the several tables, it will be understood that other materials may be used as backing materials over armor plate.

Figure 6A:
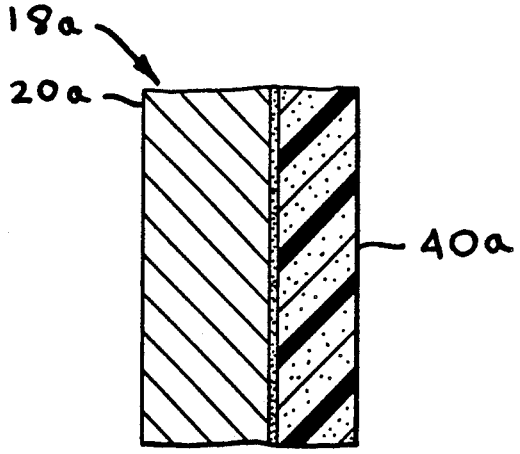
FIG. 6A is a vertical section taken through an armor plate having a spall backing material contiguously attached thereto and illustrating an alumina-loaded polymer as the backing material.
Figure 6B:
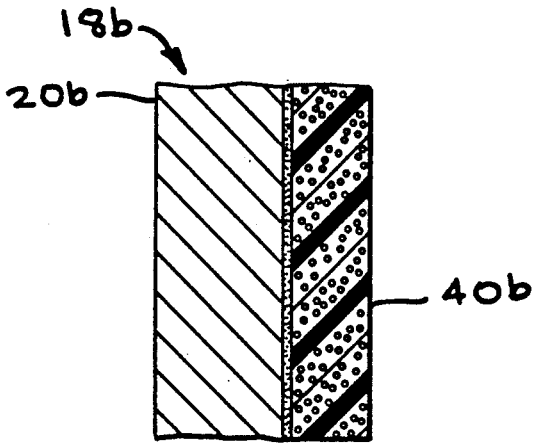
FIG. 6B is a vertical section taken through an armor plate having a spall backing material contiguously attached thereto and illustrating an alumina-loaded polymer as the backing material having alumina beads and epoxy resin therein.
Figure 6C:
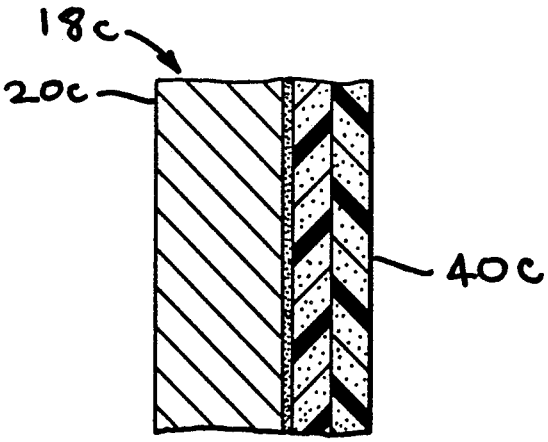
FIG. 6C is a vertical section taken through an armor plate having a spall backing material contiguously attached thereto and illustrating two plates of an alumina-loaded polymer as the backing material.

For example, steel fibers or powders, or fibers or powders from other metals, may be added to the micron range alumina powders along with an organic binder when making the backing material. Furthermore, the backing material may include composite fibers or woven composite cloth having the desired impedance. As illustrated in FIG. 6, the optional interlayer of EPDM, which is an uncured rubber, or a cloth plus adhesive, or any other suitable bonding material may be used between the backing material and armor to more readily apply the backing material contiguously to the armor. In addition, the consistency of the backing material may be in the form of hard tiles or plates, depending upon the type of armor surface to which they are to be applied, or may be of relatively soft consistency such as putty which can be easily adhered to corners and curved surfaces of the armor being protected from spallation.

TABLE 7

| ID NO. | WAR HEAD | OBL. | Target ranking according to 99% spall diameter. TARGET MTL. | TARGET THK. | BACKING MATERIAL MTL. | BACKING MATERIAL THK. | WITNESS MTL. | 99% SPALL DIA. | PEN. HOLE VOL. | BACK SPALL VOL. |
|---|---|---|---|---|---|---|---|---|---|---|
| 17 | TOW II | 0 DEG. | 7039 | 1.00 | F.F. | 0.50 | AL | 31.00 | 2.87 | 1.15 |
| 15 | TOW II | 0 DEG. | 7039 | 1.00 | UNF. | 0.58 | AL | 34.00 | 2.46 | 0.09 |
| 13 | TOW II | 0 DEG. | 7039 | 1.00 | F.F. | 0.50 | AL | 36.00 | 1.29 | 0.00 |
| 16 | TOW II | 0 DEG. | 7039 | 1.00 | UNF. | 0.30 | AL | 36.00 | 5.23 | 1.63 |
| 18 | TOW II | 0 DEG. | 7039 | 1.00 | AL 1100 | 0.50 | AL | 37.00 | 1.43 | 0.00 |
| 10 | TOW II | 0 DEG. | 7039 | 1.00 | F.F. | 0.38 | AL | 40.00 | 2.09 | 0.25 |
| 11 | TOW II | 0 DEG. | 7039 | 1.00 | BISQUE | 0.44 | AL | 40.00 | 2.75 | 1.21 |
| 12 | TOW II | 0 DEG. | 7039 | 1.00 | BISQUE | 0.44 | AL | 40.00 | 1.65 | 1.69 |
| 05 | TOW II | 0 DEG. | 7039 | 1.00 | NONE | | AL/ST | 42.00 | 4.45 | 1.64 |
| 14 | TOW II | 0 DEG. | 7039 | 1.00 | BISQUE | 0.59 | AL | 42.00 | 5.19 | 1.80 |
| 09 | TOW II | 0 DEG. | 7039 | 1.00 | BISQUE | 0.31 | AL | 46.00 | 4.64 | 1.98 |
| 08 | TOW II | 0 DEG. | 7039 | 1.00 | NONE | | AL | 48.00 | 3.98 | 0.69 |
| 07 | TOW II | 0 DEG. | 7039 | 1.00 | NONE | | AL/ST | 48.00 | 3.14 | 2.46 |
| 21 | TOW II | 0 DEG. | 7039 | 1.00 | Liner | 1.38 | ST | 21.00 | 3.11 | 1.18 |
| 20 | TOW II | 0 DEG. | 7039 | 1.00 | AL 1100 | .19/.1 | ST | 36.00 | 4.15 | 0.00 |
| 46 | TOW II | 0 DEG. | 7039 | 1.00 | ALP | 0.38 | ST | 36.00 | 2.09 | 0.13 |
| 32 | TOW II | 0 DEG. | 7039 | 1.00 | F.F./ST | .5/.06 | ST | 37.00 | 3.33 | 1.12 |
| 19 | TOW II | 0 DEG. | 7039 | 1.00 | AL 1100 | 0.19 | ST | 39.00 | 2.46 | 0.81 |
| 04 | TOW II | 0 DEG. | 7039 | 1.00 | BISQUE | 0.44 | ST/ST | 40.00 | 5.98 | 1.71 |
| 06 | TOW II | 0 DEG. | 5083 | 1.00 | NONE | | AL/ST | 48.00 | 3.98 | 1.43 |
| 39 | 3.2" | 0 DEG. | 7039 | 1.00 | ALP | 0.50 | ST | 12.00 | 0.54 | 0.60 |
| 37 | 3.2" | 0 DEG. | 7039 | 1.00 | ALP | 0.38 | ST | 16.00 | 0.25 | 0.00 |
| 22 | 3.2" | 0 DEG. | 7039 | 1.00 | F.F. | 0.50 | ST | 26.00 | 1.13 | 0.83 |
| 25 | 3.2" | 0 DEG. | 7039 | 1.00 | UNF. | 0.30 | ST | 30.00 | 1.00 | 0.42 |
| 38 | 3.2" | 0 DEG. | 7039 | 1.00 | F.F./Liner | .5/.29 | ST | 35.00 | 0.99 | 1.02 |

TABLE 7-continued

| ID NO. | WAR HEAD | OBL. | Target ranking according to 99% spall diameter. TARGET MTL. | TARGET THK. | BACKING MATERIAL MTL. | BACKING MATERIAL THK. | WITNESS MTL. | 99% SPALL DIA. | PEN. HOLE VOL. | BACK SPALL VOL. |
|---|---|---|---|---|---|---|---|---|---|---|
| 23 | 3.2" | 0 DEG. | 7039 | 1.00 | BISQUE | 0.59 | ST | 35.00 | 1.06 | 0.03 |
| 26 | 3.2" | 0 DEG. | 7039 | 1.00 | AL 1100 | 0.19 | ST | 42.00 | 0.44 | 0.67 |
| 24 | 3.2" | 0 DEG. | 7039 | 1.00 | NONE | | ST | 48.00 | 1.09 | 1.25 |
| 33 | 3.2" | 0 DEG. | 5083 | 1.00 | BISQUE | 0.42 | ST | 18.00 | 3.09 | 1.51 |
| 35 | 3.2" | 0 DEG. | 5083 | 1.00 | AL 1100 | 0.19 | ST | 38.00 | 1.63 | 0.47 |
| 36 | 3.2" | 0 DEG. | 5083 | 1.00 | AL 1100 | 0.30 | ST | 40.00 | 1.09 | 0.00 |
| 34 | 3.2" | 0 DEG. | 5083 | 1.00 | NONE | | ST | 46.00 | 2.38 | 0.34 |
| 59 | 105 mm | 53 DEG. | 7039 | 1.50 | SP'D Liner | 0.73 | ST | OBL | 2.96 | 2.58 |
| 57 | 105 mm | 53 DEG. | 7039 | 1.50 | BISQUE | 0.59 | ST | OBL | 3.87 | 0.31 |
| 58 | 105 mm | 53 DEG. | 7039 | 1.50 | Liner | 1.23 | ST | OBL | 2.72 | 0.28 |
| 60 | 105 mm | 53 DEG. | 7039 | 1.50 | ALP | 0.40 | ST | OBL | 2.84 | 1.46 |
| 56 | 105 mm | 53 DEG. | 7039 | 1.50 | F.F. | 0.50 | ST | OBL | 2.66 | 0.00 |
| 55 | 105 mm | 53 DEG. | 7039 | 1.50 | NONE | | ST | OBL | 2.49 | 5.27 |
| 54 | 105 mm | 53 DEG. | 5083 | 1.50 | NONE | | ST | OBL | 2.54 | 1.55 |
| 53 | 105 mm | 53 DEG. | 5083 | 1.00 | NONE | | ST | OBL | 1.91 | 0.43 |
| 42 | 105 mm | 53 DEG. | 7039 | 1.00 | ALP | 0.38 | ST | OBL | 2.01 | 0.40 |
| 41 | 105 mm | 53 DEG. | 7039 | 1.00 | NONE | | ST | OBL | 1.91 | 0.40 |
| 48 | 105 mm | 0 DEG. | 5083 | 1.50 | NONE | | ST | 48.00 | 0.92 | 1.04 |
| 50 | 105 mm | 0 DEG. | 5083 | 1.00 | F.F. | 0.25 | ST | 29.00 | 0.64 | 0.00 |
| 44 | 105 mm | 0 DEG. | 5083 | 1.00 | ALP | 0.25 | ST | 32.00 | 0.55 | 0.00 |
| 45 | 105 mm | 0 DEG. | 5083 | 1.00 | ALP | 0.38 | ST | 35.00 | 0.66 | 0.00 |
| 51 | 105 mm | 0 DEG. | 5083 | 1.00 | NONE | | ST | 43.00 | 0.72 | 0.40 |
| 47 | 105 mm | 0 DEG. | 7039 | 1.50 | NONE | | ST | 48.00 | 0.78 | 1.33 |
| 49 | 105 mm | 0 DEG. | 7039 | 1.00 | F.F. | 0.25 | ST | 30.00 | 0.49 | 0.20 |
| 43 | 105 mm | 0 DEG. | 7039 | 1.00 | ALP | 0.25 | ST | 39.00 | 0.53 | 0.00 |
| 52 | 105 mm | 0 DEG. | 7039 | 1.00 | NONE | | ST | 44.00 | 0.38 | 1.60 |
| 40 | 105 mm | 0 DEG. | 7039 | 1.00 | AL 1100 | 0.32 | ST | NA | 0.95 | 0.57 |

NOTES:
(1) OBLIQUE SHOTS RANKED BY VISUAL EXAMINATION OF WITNESS PHOTOGRAPHS
(2) NO WITNESS WAS USED ON SHOT 40

FIGS. 7A and 7B illustrate the results of test shot No. 48. An armor plate 20*a*, without spall backing material, indicates that a substantial amount of spall was released from the inner face 26*a* by the cross-sectional area of a spall cavity 70*a* as compared to the hole 72*a* formed by the jet of the 105 mm spaced charge weapon. The scale on the armor plates in FIGS. 7A, 8A, 9A and 11 are all in inches. FIG. 7B illustrates that the witness plate 54*a* was perforated by the jet at 74*a* and by a fragment of the copper jet tip (not shown) of the weapon at 76*a*. A ring of holes 78*a* indicate that a large amount of lethal spall was propelled through the witness plate 54*a*.

FIGS. 8A and 8B illustrate the results of test shot No. 13. The armor plate had a 0.50 thick fully-fired alumina spall backing material 40*b* secured thereto. A TOW 11 weapon was used making a larger hole 72*b* through the target with much less and much finer spall being propelled therethrough as indicated by the hole 72*b* and the spall cavity 70*b* in the spall backing material. The aluminum witness plate 54*b* indicates that a very large hole 74*b* was apparently caused by a portion of the slug and by burning therethrough by the jet, but that very small particles of backing material spall contacted the aluminum witness plate at 78*b* doing little damage.

Figure 9A:
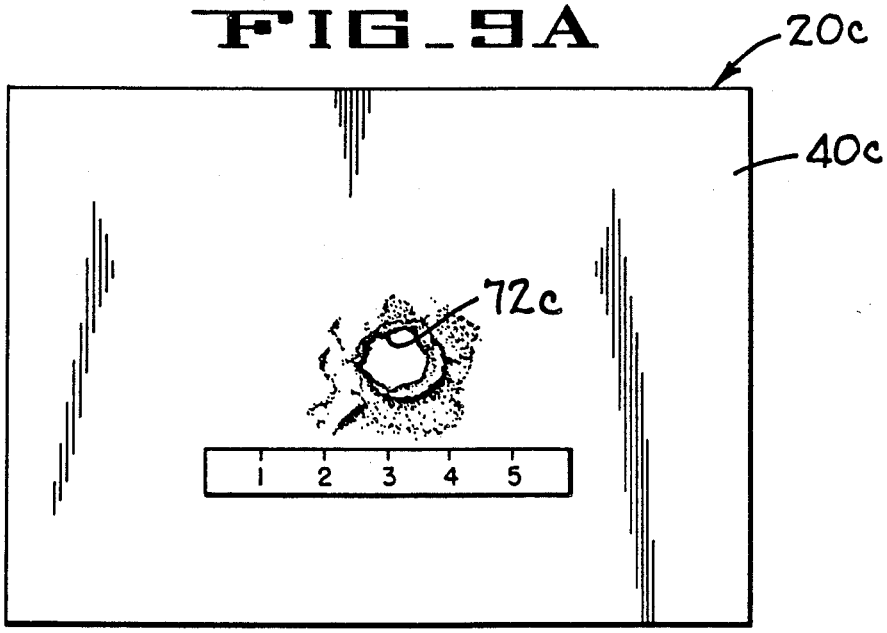
FIG. 9A is a copy of a photograph illustrating the back of an armor test plate for shot 45 having an aluminum-loaded polymer spall backing with indications of very little spall being released.
Figure 9B:
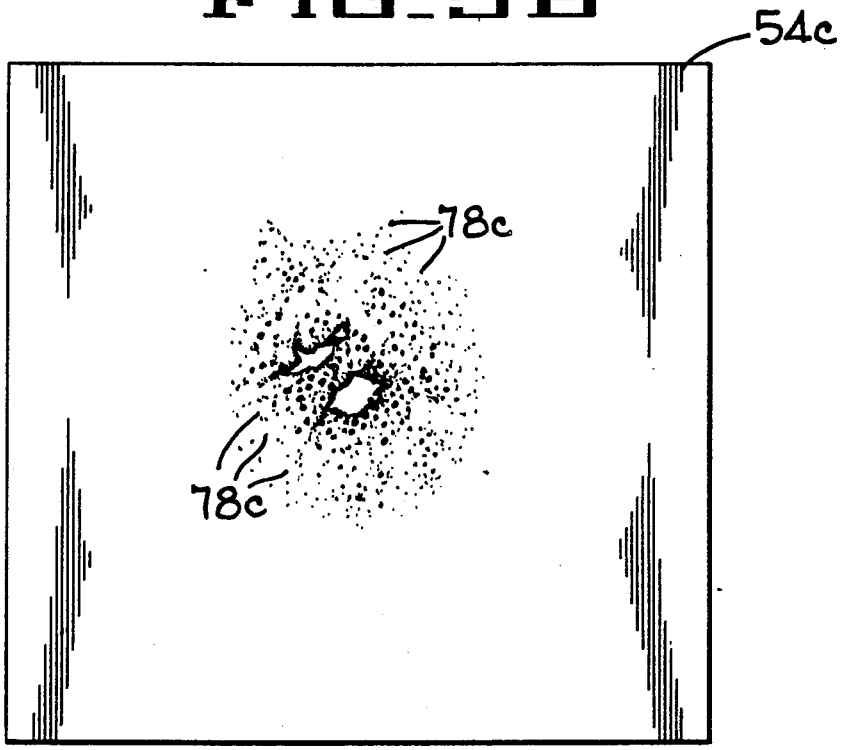
FIG. 9B is a copy of a photograph illustrating the front of the witness plate for shot 45 having a pair of small holes from fragments of the slug with a small spall ring therearound.

FIGS. 9A and 9B illustrate the results of test shot 45. The armor plate 20*c* had a 0.38 inch ALP backing material 40*c* bonded thereto which minimized release of spall from the armor material as indicated by the hole 72*c* and primarily directed nonlethal backing material spall against the witness plate 54*c* as indicated at 78*c*. The warhead was a 105 mm spaced charge.

Figure 10A:
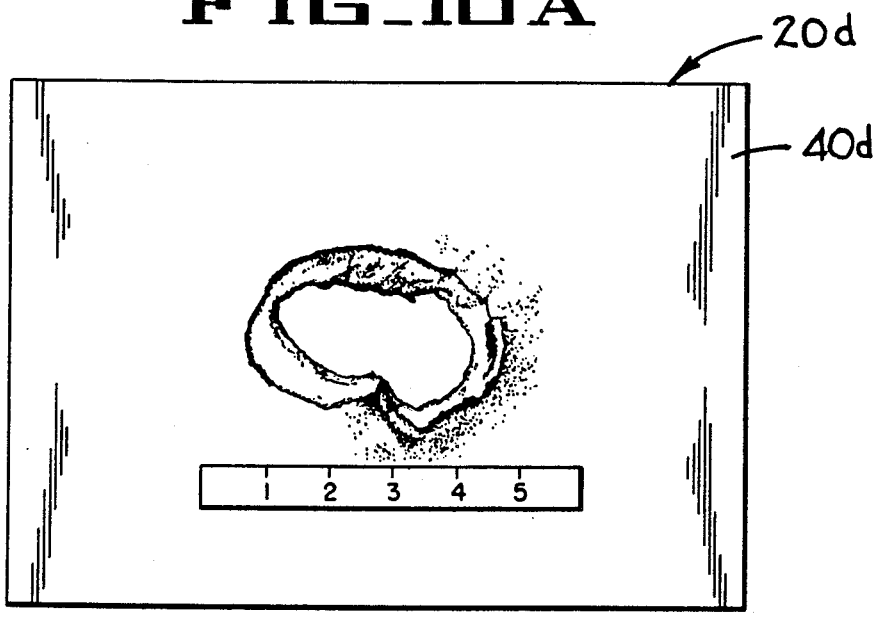
FIG. 10A is a copy of a photograph illustrating the back of an armor test plate for shot 46 with an alumina loaded polymer as the backing material showing larger holes from portions of the slug and much smaller holes created by spall fragment from the armor plate.
Figure 10B:
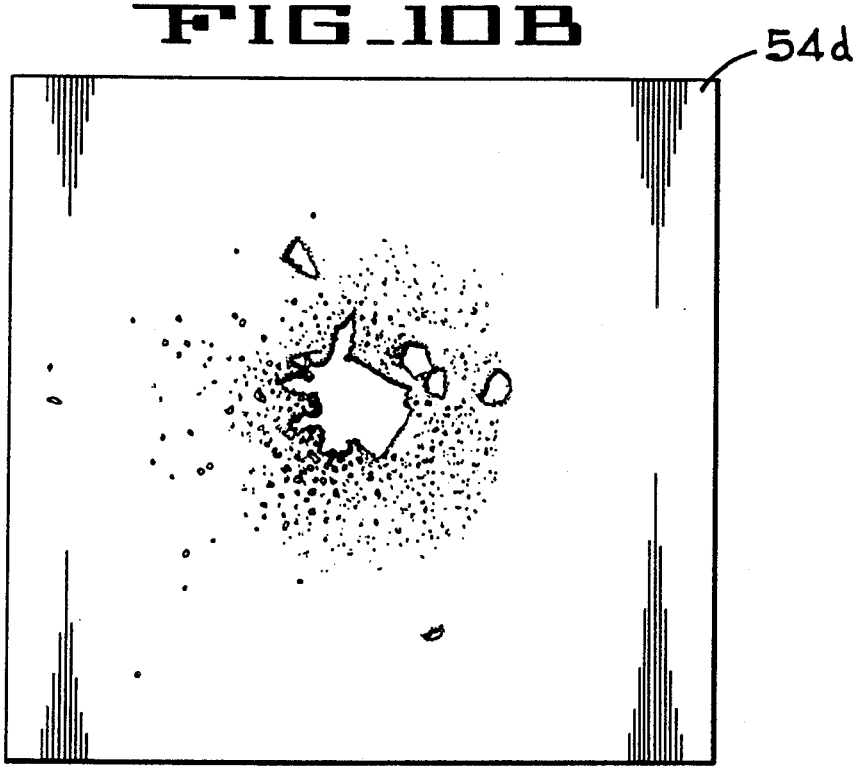
FIG. 10B is a copy of a photograph of the witness plate of shot 46.

FIGS. 10A and 10B illustrates the results of test shot 46 by a TOW 11 against an armor plate 20*d* having a 0.38 inch ALP backing material 40*d* bonded thereto. The steel armor plate witness 54*d* indicated some spall damage, indicting that the thickness of the backing material should be increased for the TOW 11 weapon.

Figure 11A:
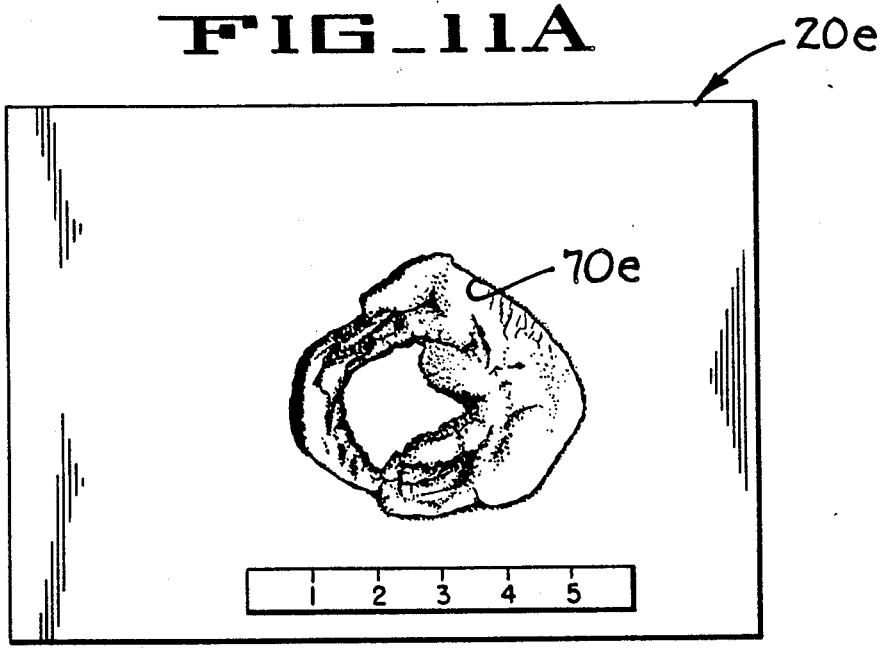
FIG. 11A is a copy of a photograph illustrating the back of an armor test plate that is 1.5 inches thick for shot 55 without backing material protection with the obliquity of the shot being 53 degrees.
Figure 11B:
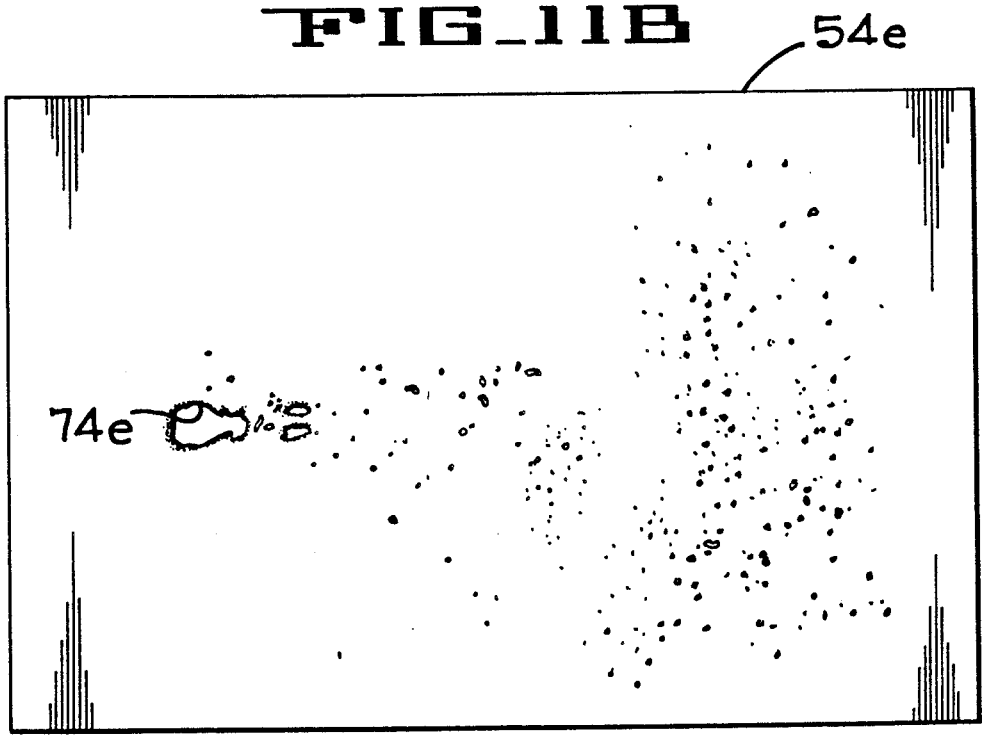
FIG. 11B is a copy of a photograph of the witness plate of shot 55.

FIGS. 11A and 11B illustrates the results of shot 55 which was taken at an oblique angle of 53° by a 105 mm warhead against an armor plate 20*e* without any spall backing material. The armor plate 20*e* indicates that considerable spall was released by the considerable size and depth of the spall cavity 70*e*. The witness plate 54*a* illustrates a small jet hole 74*e* with considerable amount of spall spread in a wide angle over the right portion thereof.

From the foregoing description it will be apparent that several types of backing material have been disclosed and tested for preventing or suppressing warhead induced formations of lethal spall. If the impedance of the armor material is the same or less than the impedance of the backing material, the formation of lethal armor spall will be prevented. If the armor and backing material are used in a vehicle and the total weight of the vehicle must be minimized for improving performance, the thickness of the backing material may be reduced to minimize the increase in weight causing the impedance of the backing material to become less than that of the armor material. Depending upon the thickness of the backing material, lethal armor spall with potential for some damage and nonlethal backing material spall may be formed and distributed in a narrow cone angle within the vehicle depending upon the impact delivered by the warhead contacting the armor.

Although the best mode contemplated for carrying out the present invention has been herein shown and described it will be apparent that modification and variation may be made without departing from what is regarded to be the subject matter of the invention.

What is claimed is:

1. An apparatus for suppressing spall from being created on an inside surface of metal armor when an outside surface is being subjected to an impulse load from a weapon causing a compressive stress to be applied from the outside surface to the inside surface of the metal armor, comprising:

means defining spall backing material formed from materials which if fractured due to stresses transmitted through the metal armor form nonlethal fragments of low mass and kinetic energy, said spall backing material having a sonic impedance such that the stress reflected into the metal armor by the backing material at least suppresses the formation of spall in the armor; and means for contiguously securing the spall backing material to said inside surface, said backing material being an alumina-loaded polymer consisting of about 70% by weight of alumina beads suspended in an epoxy resin with the beads being about 87% alumina.

2. An apparatus according to claim 1 wherein a surface of said spall backing material acts as said means for securing the spall backing material to said armor.

3. An apparatus according to claim 1 wherein said alumina-loaded polymer has a thickness between about 0.25–0.50 of an inch.

* * * * *